US012741308B2

(12) United States Patent
Sonobe et al.

(10) Patent No.: US 12,741,308 B2
(45) Date of Patent: Sep. 22, 2026

(54) MANUFACTURING METHOD OF PRESS FORMED PRODUCT, PRESS FORMING APPARATUS, AND PRESS FORMING LINE

(71) Applicant: NIPPON STEEL CORPORATION, Tokyo (JP)

(72) Inventors: Soma Sonobe, Tokyo (JP); Satoshi Shirakami, Tokyo (JP); Takashi Ariga, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 320 days.

(21) Appl. No.: 17/784,295

(22) PCT Filed: Dec. 17, 2020

(86) PCT No.: PCT/JP2020/047274
§ 371 (c)(1),
(2) Date: Jun. 10, 2022

(87) PCT Pub. No.: WO2021/125293
PCT Pub. Date: Jun. 24, 2021

(65) Prior Publication Data

US 2023/0057735 A1 Feb. 23, 2023

(30) Foreign Application Priority Data

Dec. 18, 2019 (JP) ..... 2019-227948

(51) Int. Cl.
*B21D 22/26* (2006.01)

(52) U.S. Cl.
CPC ..... *B21D 22/26* (2013.01)

(58) Field of Classification Search
CPC ..... B21D 22/22; B21D 22/26; B21D 24/04; B21D 24/16

(Continued)

(56) References Cited

U.S. PATENT DOCUMENTS 8,875,555 B2 11/2014 Iwata et al.
9,937,546 B2 4/2018 Urabe (Continued)

FOREIGN PATENT DOCUMENTS

CN 106132580 A * 11/2016 ..... B21D 19/08
DE 102017102356 * 4/2018 ..... B21D 19/08

(Continued)

OTHER PUBLICATIONS

International Preliminary Report on Patentability (Form PCT/IPEA/409) for International Application No. PCT/JP2020/047274, dated Sep. 8, 2021, with English translation.
Written Opinion of the International Searching Authority (Form PCT/ISA/237) for International Application No. PCT/JP2020/047274, dated Mar. 23, 2021, with English translation.

*Primary Examiner* — Christopher L Templeton
*Assistant Examiner* — P Derek Pressley
(74) *Attorney, Agent, or Firm* — Birch, Stewart, Kolasch & Birch, LLP

(57) ABSTRACT

A manufacturing method of a press forming product, includes: constraining a first face of an intermediate formed product, the intermediate formed product including the first face, a raised face, and a first ridgeline located between the first face and the raised face, and performing flange forming of press forming the raised face into a second face, a flange, and a second ridgeline located between the second face and the flange, wherein: the first ridgeline extends while being convexly curved in a direction from the raised face toward the first face, and the second ridgeline extends while being convexly curved in a direction from the flange toward the second face, viewed from a press direction of the press forming; a convex direction of the first ridgeline in a cross section along the press direction intersecting with the first ridgeline and a convex direction of the second ridgeline in (Continued)

a cross section along the press direction intersecting with the second ridgeline are on the same side; a curvature radius, on a straight line orthogonal to the second ridgeline, in an extending direction of the first ridgeline at an intersection with the straight line in the intermediate formed product is larger than a curvature radius in an extending direction of the second ridgeline on the straight line after the flange forming step; and an angle formed by the second face at a position corresponding to the first ridgeline after the flange forming step is larger than an angle formed by the raised face and the first face which are adjacent to the first ridgeline in the intermediate formed product.

9 Claims, 21 Drawing Sheets

(58) Field of Classification Search
USPC ..... 72/248, 350
See application file for complete search history.

(56) References Cited

U.S. PATENT DOCUMENTS

| | | | | |
|---|---|---|---|---|
| 2012/0073350 | A1* | 3/2012 | Iwata | B21C 23/186 72/347 |
| 2015/0367397 | A1* | 12/2015 | Uchiyama | B21D 53/88 72/379.2 |
| 2016/0121384 | A1* | 5/2016 | Sumikawa | B21D 22/26 72/352 |

FOREIGN PATENT DOCUMENTS

| | | | | | |
|---|---|---|---|---|---|
| JP | 4-31773 | A | | 2/1992 | |
| JP | 9-174166 | A | | 7/1997 | |
| JP | 2009214118 | A | * | 9/2009 | B21D 22/20 |
| JP | 2012-71332 | A | | 4/2012 | |
| JP | 5510533 | B1 | | 6/2014 | |
| JP | 5636846 | B2 | | 12/2014 | |
| JP | 2015-100812 | A | | 6/2015 | |
| JP | 6011680 | B1 | * | 10/2016 | B21D 22/20 |
| WO | WO-2015053035 | A1 | * | 4/2015 | B21D 22/26 |

* cited by examiner

MANUFACTURING METHOD OF PRESS FORMED PRODUCT, PRESS FORMING APPARATUS, AND PRESS FORMING LINE

TECHNICAL FIELD

This disclosure relates to a manufacturing method of a press formed product for manufacturing a press formed product having a portion formed by stretch flange deformation, a press forming apparatus, and a press forming line.

BACKGROUND ART

Due to the recent tightening of fuel consumption regulation, a reduction in weight of the vehicle body of an automobile is required and reductions in weight of components constituting the vehicle body are also required. However, merely replacement of materials of the components with the ones having high strength and small thickness may cause a reduction in rigidity, and therefore it is desirable to cope with the requirement for the reductions in weight by improving the shapes and structures of the components along with strengthening the materials.

FIG. 1 is a view illustrating a vehicle body framework of an automobile. In the vehicle body framework of the automobile, for example, there is a portion where a component such as a front side member, a rear side member, a cross member or the like and another component are joined together, and at that joint portion, a first component 80 and a second component 81 are sometimes fixed in a T-shape as illustrated in FIG. 2. In this example, the first component 80 has a first flange 82*a* and a second flange 82*b* extending in different directions from each other, and each of the first flange 82*a* and the second flange 82*b* is joined to the second component 81 by welding. In the example of FIG. 2, the first flange 82*a* and the second flange 82*b* are not continuously connected, but it is preferable that the first flange 82*a* and the second flange 82*b* are continuously connected like a portion surrounded by a broken line in FIG. 3 from the viewpoint of collision performance and improvement in rigidity of the vehicle body.

However, in the case of manufacturing a component in a shape n which the first flange 82*a* and the second flange 82*b* are continuously connected, if the forming is performed to raise a blank, a tensile stress occurs at a third flange 82*c* existing between the first flange 82*a* and the second flange 82*b*, causing a tensile strain in forming. More specifically, the third flange 82*c* is formed accompanying a so-called stretch flange deformation. A component having a portion (hereinafter, referred to as a "stretch flange part") where the stretch flange deformation occurs is highly difficult to form, and therefore, for example, a tip breakage of the flange is likely to occur at the stretch flange part. In particular, in the case where the material of the component has high strength like a high-tensile steel, the difficulty of forming with the stretch flange deformation becomes higher.

As a manufacturing method of the component having the stretch flange part, Patent Document 1 discloses a press forming method including a first forming step of forming an intermediate formed product and a second forming step of forming a flange in a product shape from the intermediate formed product. In Patent Document 1, a mountain shaped portion convex towards the top portion is formed on a flange portion of the preformed shape part in the first forming step, and the flange portion having a product shape is formed by making the height of the flange higher in the second forming step thereafter. Patent Document 2 discloses retaining a top plate part at a position separated from an outer peripheral edge part of the top plate part when forming the flange by folding the top plate part, and forming a flange in that state. Patent Document 3 discloses a method of providing a convex part on a metal thin plate by bulge forming, then generating wrinkling on a plate face at a base end of the convex part by drawing, and then forming a hole part at a top face of the convex part by piercing.

PRIOR ART DOCUMENT

Patent Document

Patent Document 1: Japanese Patent No. 5510533

Patent Document 2: Japanese Laid-open Patent Publication No. 2015-100812

Patent Document 3: Japanese Laid-open Patent Publication No. H4-031773

DISCLOSURE OF THE INVENTION

Problems to be Solved by the Invention

In the forming methods in Patent Document 1 and Patent Document 2, it is necessary to process the blank in a manner to extend it in a height direction of the flange in order to secure the height of the flange when forming the flange in a product shape, and therefore has a less effect of suppressing the tensile strain at the flange tip. In the forming method in Patent Document 3, wrinkling occurs at a base portion of the flange, thus limiting the usage as a component. Accordingly, for the component having the stretch flange part, a new forming method for manufacturing a component while suppressing the tensile strain is required.

This disclosure has been made in consideration of the above circumstances and has an object to suppress tensile strain occurring at a flange when manufacturing a press formed product having a stretch flange part.

Means for Solving the Problems

An aspect of this disclosure for solving the above problem is a manufacturing method of a press forming product, the method including: constraining a first face of an intermediate formed product, the intermediate formed product including the first face, a raised face, and a first ridgeline located between the first face and the raised face, and performing flange forming of press forming the raised face into a second face, a flange, and a second ridgeline located between the second face and the flange, wherein: the first ridgeline extends while being convexly curved in a direction from the raised face toward the first face, and the second ridgeline extends while being convexly curved in a direction from the flange toward the second face, viewed from a press direction of the press forming; a convex direction of the first ridgeline in a cross section along the press direction intersecting with the first ridgeline and a convex direction of the second ridgeline in a cross section along the press direction intersecting with the second ridgeline are on the same side; a curvature radius, on a straight line orthogonal to the second ridgeline, in an extending direction of the first ridgeline at an intersection with the straight line in the intermediate formed product is larger than a curvature radius in an extending direction of the second ridgeline on the straight line after the flange forming; and an angle formed by the second face at a position corresponding to the first ridgeline after the flange forming is larger than an angle formed by the raised face and the first face which are adjacent to the first ridgeline in the intermediate formed product.

An aspect of this disclosure according to another viewpoint is a press forming apparatus, including a punch, a die, and a pad, wherein: the punch includes a punch vertical wall part, a punch bottom face part, and a concave ridgeline part located between the punch vertical wall part and the punch bottom face part; the die includes a die vertical wall part, a die bottom face part, and a die shoulder ridgeline part located between the die vertical wall part and the die bottom face part; the pad includes a pad vertical wall part, a pad bottom face part, and a pad ridgeline part located between the pad vertical wall part and the pad bottom face part; the pad ridgeline part extends while being convexly curved in a direction from the die toward the pad in a state viewed in a press direction; the die shoulder ridgeline part extends while being convexly curved in a direction from the punch vertical wall part toward the die vertical wall part in the state viewed in the press direction; the pad vertical wall part is arranged adjacent to the die; the punch vertical wall part and the die vertical wall part are oppositely adjacent to each other at a forming bottom dead center; the punch bottom face part and the die bottom face part are oppositely adjacent to each other at the forming bottom dead center; the pad bottom face part and the punch bottom face part are oppositely adjacent to each other at the forming bottom dead center; and a curvature radius, on a straight line orthogonal to the second ridgeline, in an extending direction of the pad ridgeline part at an intersection with the straight line is larger than a curvature radius in an extending direction of the die shoulder ridgeline part on the straight line.

Further, an aspect of this disclosure according to still another viewpoint is a press forming line including the press forming apparatus and a preforming apparatus, wherein: the preforming apparatus includes a preforming punch and a preforming die; the preforming punch includes a preforming punch vertical wall part, a preforming punch bottom face part, and a preforming punch concave ridgeline part located between the preforming punch vertical wall part and the preforming punch bottom face part; the preforming die includes a preforming die vertical wall part, a preforming die bottom face part, and a preforming die shoulder ridgeline part located between the preforming die vertical wall part and the preforming die bottom face part; the preforming die shoulder ridgeline part extends while being convexly curved in a direction from the preforming punch vertical wall part toward the preforming die vertical wall part in a state viewed in a press direction; the preforming punch vertical wall part and the preforming die vertical wall part are oppositely adjacent to each other at a forming bottom dead center; the preforming punch bottom face part and the preforming die bottom face part are oppositely adjacent to each other at the forming bottom dead center; a curvature radius in an extending direction of the preforming die shoulder ridgeline part at an intersection with a straight line orthogonal to the die shoulder ridgeline part of the press forming apparatus and intersecting with the preforming die shoulder ridgeline part of the preforming apparatus is larger than a curvature radius in an extending direction of the die shoulder ridgeline part on the straight line; and an angle formed by the die bottom face part and the pad bottom face part which are adjacent to the pad ridgeline part is larger than an angle formed by the preforming die vertical wall part and the preforming die bottom face part which are adjacent to the preforming die shoulder ridgeline part in a cross section along the press direction intersecting with the preforming die shoulder ridgeline part of the preforming die of the preforming apparatus and the pad ridgeline part of the pad of the press forming apparatus.

Effect of the Invention

According to this disclosure, it is possible to suppress tensile strain occurring at a flange when manufacturing a press formed product having a stretch flange part.

EMBODIMENTS FOR CARRYING OUT THE INVENTION

Figure 1:
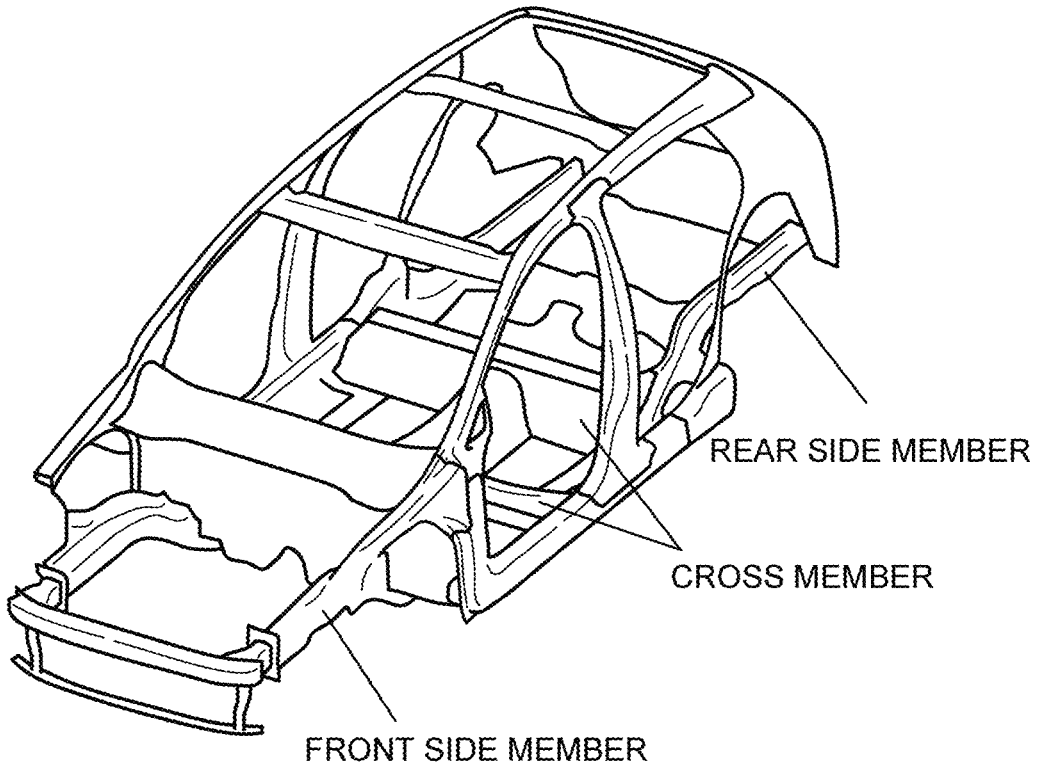
FIG. 1 is a view illustrating an example of a vehicle body framework of an automobile.
Figure 2:
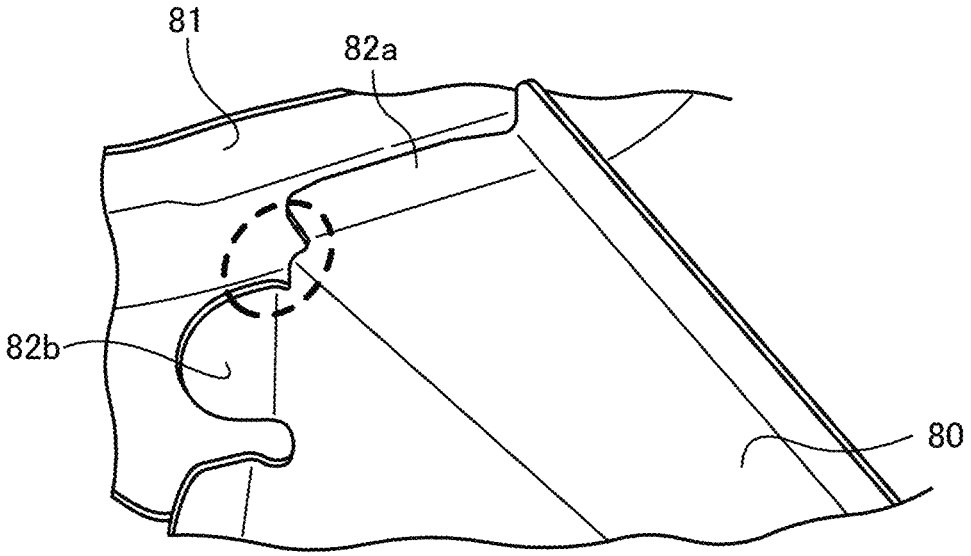
FIG. 2 is a view illustrating an example of a joint shape at a joining part of a first component and a second component.

Hereinafter, an embodiment of this disclosure will be explained while referring to the drawings. Note that the same codes are given to components having substantially the same functional configurations in the description and the drawings to omit duplicate explanation.

Figure 4:
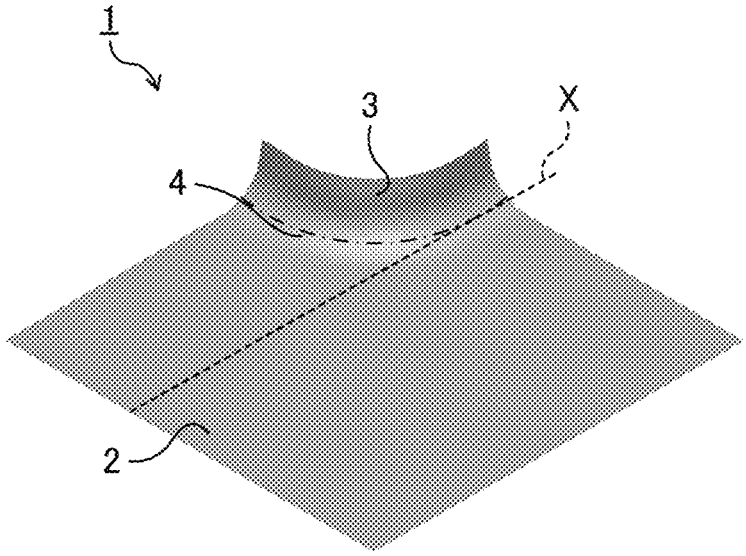
FIG. 4 is a view illustrating an example of a press formed product having a stretch flange part.

In this embodiment, a method of manufacturing a press formed product 1 in such a shape as in FIG. 4 as an example of a press formed product having a stretch flange part will be explained. This press formed product 1 has a flat plate-shaped face (second face) 2, a flange 3 which is made by folding and extending a part of the face 2 in a direction (upward in the drawing) intersecting with the face 2, and a ridgeline (second ridgeline) 4 which connects the face 2 and the flange 3. The flange 3 is formed by folding upward a part of a rim of the flat plate-shaped face 2 by press forming. The ridgeline 4 continuously exists between the face 2 and the flange 3. The flange 3 is curved to be convex to the inside of the face 2 in plan view viewed from a plate thickness direction of the face 2, and a stretch flange deformation occurs in forming. In this embodiment, the press formed product 1 is manufactured through a preforming step of forming an intermediate formed product 11 as in FIG. 5(*b*) from a flat plate-shaped blank 10 having a curved line-shaped cutout part 10*a* as in FIG. 5(*a*), and a flange forming step of forming the flange 3 as in FIG. 5(*c*) from the intermediate formed product 11. Both sides of the cutout part 10*a* are not continuous in FIG. 5, but the cutout part 10*a* may be annular. Specifically, the cutout part 10*a* may be a hole. In other words, the cutout part 10*a* may be only a portion expressed in FIG. 5, or the same structure may exist also outside the drawing centering around the back corner in FIG. 5. This also applies to later-explained FIG. 13, FIG. 14, FIG. 19, FIG. 20, FIG. 21, FIG. 23, FIG. 24, and FIG. 25. Note that the material of the blank 10 is not particularly limited and, for example, a metal plate such as a steel plate, an aluminum alloy plate, a magnesium alloy plate or the like may be employed.

<Preforming Step>

Figure 5A:
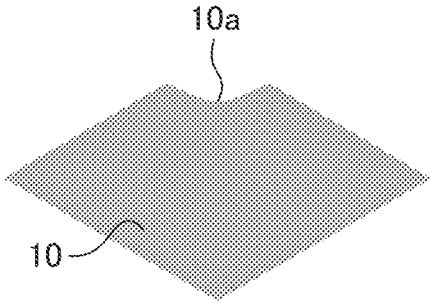
FIG. 5 is a view illustrating shapes in a manufacturing process of a press formed product having a stretch flange part according to an embodiment of this disclosure, (a) illustrating the shape of a blank, (b) illustrating the shape of an intermediate formed product after a preforming step, and (c) illustrating the shape of a press formed product after a forming process.
Figure 5B:
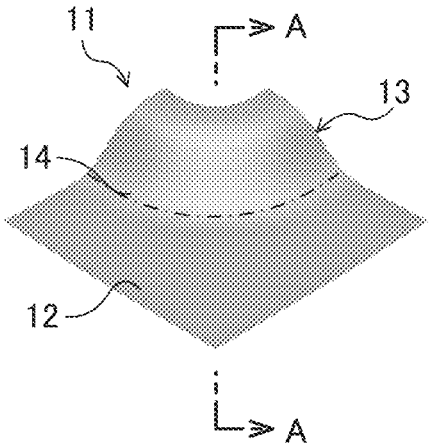
Figure 5C:
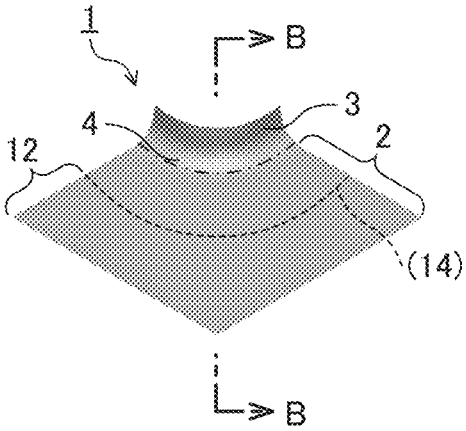

As illustrated in FIG. 5(*b*), the intermediate formed product 11 manufactured in the preforming step has a flat plate-shaped first face 12, a raised face 13 being a face which is formed by raising a portion including the cutout part 10*a* of the blank 10 upward in the drawing and is raised with respect to the first face 12, and a first ridgeline 14 located between the first face 12 and the raised face 13. In plan view, the first ridgeline 14 extends while being convexly curved in a direction from the raised face 13 toward the first face 12. Hereinafter, the plan view is expressed as plan view viewed in a press direction, and this is the same meaning as plan view viewed in a plate thickness direction of the first face 12. The raised face 13 is formed by pressing the blank 10.

Figure 6:
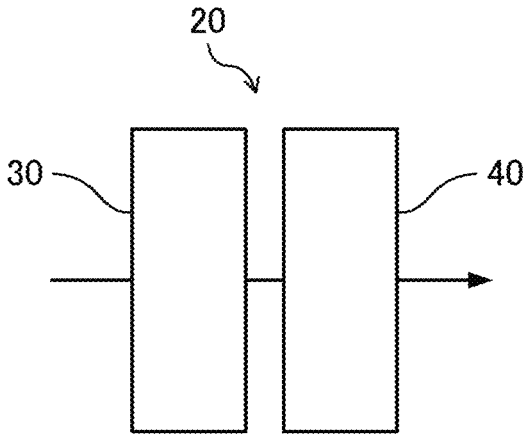
FIG. 6 is a view illustrating an arrangement example of a preforming apparatus and a press forming apparatus of a press forming line.

The intermediate formed product 11 is manufactured, for example, using a preforming apparatus 30 of a press forming line 20 as illustrated in FIG. 6. In the example in FIG. 6, the press forming line 20 includes the preforming apparatus 30 which forms the intermediate formed product 11 from the blank 10, and a press forming apparatus 40 which forms the press formed product 1 from the intermediate formed product 11. The preforming apparatus 30 and the press forming apparatus 40 are arranged close to each other, and continuously perform the press forming on the blank 10. Note that the preforming apparatus 30 and the press forming apparatus 40 may be provided at positions apart from each other. In this case, for example, the intermediate formed product 11 formed in the preforming apparatus 30 is temporarily stored, then after a stock of the intermediate formed products 11 reaches a predetermined amount, the stored intermediate formed products 11 are collectively carried to the press forming apparatus 40, and the intermediate formed products 11 are subjected to the press forming one by one in the press forming apparatus 40.

Figure 7:
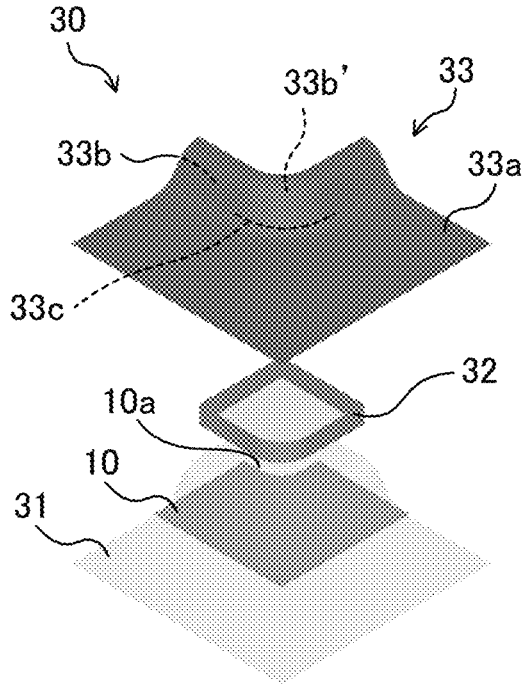
FIG. 7 is a view illustrating a configuration example of the preforming apparatus in the preforming step.
Figure 8:
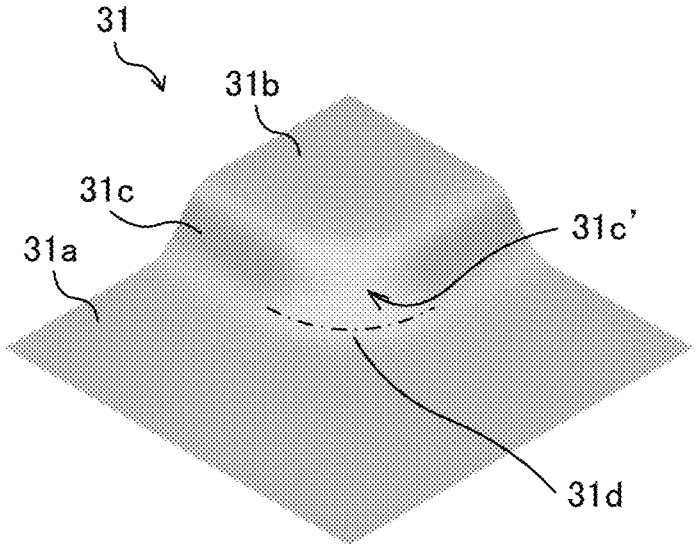
FIG. 8 is a view illustrating a punch (preforming punch) of the preforming apparatus.
Figure 9:
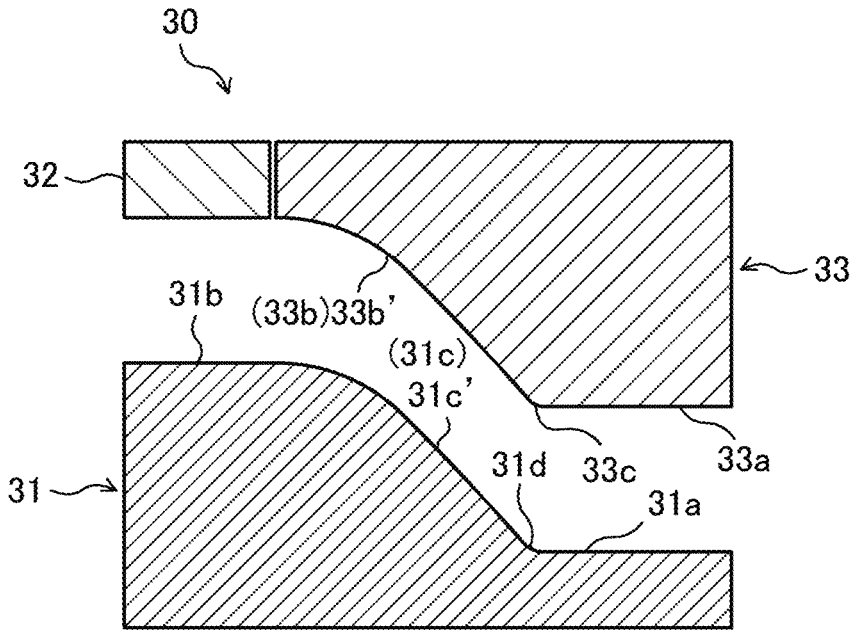
FIG. 9 is a view illustrating a cross section in a press direction of the preforming apparatus.

FIG. 7 to FIG. 9 are views illustrating a configuration example of the preforming apparatus 30 according to this embodiment. Note that FIG. 7 illustrates only a lower face shape of a preforming die 33. Further, FIG. 7 and FIG. 8 illustrate only an upper face shape of a preforming punch 31. The upper face of the preforming punch 31 and the lower face of the preforming die 33 are press faces (forming parts) which form the intermediate formed product 11 from the blank 10.

As illustrated in FIG. 7, the preforming apparatus 30 in this embodiment includes the preforming punch 31, a preforming pad 32, and the preforming die 33. The preforming punch 31 has a preforming punch bottom face part 31*a*, a preforming punch ceiling face part 31*b* located at a height different from that of the preforming punch bottom face part 31*a* (above the preforming punch bottom face part 31*a* in this embodiment), and a punch inclined face 31*c* which connects the preforming punch bottom face part 31*a* and the preforming punch ceiling face part 31*b*. The preforming punch bottom face part 31*a* and the preforming punch ceiling face part 31*b* of the preforming punch 31 in this embodiment are parallel to each other but do not need to be parallel. Further, a part of the preforming punch inclined face 31*c* is a preforming punch vertical wall part 31*c*' having a curvature like a side face of a truncated cone as illustrated in FIG. 8. The preforming punch vertical wall part 31*c*' has a curved shape convex in a direction from the preforming punch ceiling face part 31*b* toward the preforming punch bottom face part 31*a* in plan view viewed in the press direction. In short, the surface of the preforming punch vertical wall part 31*c*' is convexly curved. A portion between the preforming punch vertical wall part 31*c*' of the preforming punch inclined face 31*c* and the preforming punch bottom face part is a concave ridgeline part 31*d*. Similarly, the concave ridgeline part 31*d* has a curved line shape convex in a direction from the preforming punch ceiling face part 31*b* toward the preforming punch bottom face part 31*a* in plan view viewed in the press direction.

The preforming pad 32 is configured to be able to rise and lower at a position opposite to the preforming punch ceiling face part 31*b* of the preforming punch 31. The preforming die 33 has a preforming die bottom face part 33*a* opposite to the preforming punch bottom face part 31*a* of the preforming punch 31, and a preforming die inclined face 33*b* opposite to the preforming punch inclined face 31*c* of the preforming punch 31. As with the preforming punch vertical wall part 31*c*' of the preforming punch inclined face 31*c*, a part of the preforming die inclined face 33*b* is a preforming die vertical wall part 33*b*' having a curvature. The preforming die vertical wall part 33*b*' has a curved shape convex in a direction from the preforming die inclined face 33*b* toward the preforming die bottom face part 33*a* in plan view viewed in the press direction. In short, the surface of the preforming die vertical wall part 33*b*' is convexly curved. A portion between the preforming die vertical wall part 33*b*' of the preforming die inclined face 33*b* and the preforming die bottom face part 33*a* is a preforming die shoulder ridgeline part 33*c*. Similarly, the preforming die shoulder ridgeline part 33*c* has a curved line shape convex in a direction from the preforming die inclined face 33*b* toward the preforming die bottom face part 33*a* in plan view viewed in the press direction. The preforming die 33 is configured to be able to rise and lower at a lateral side of the preforming pad 32. Note that the configuration of the preforming apparatus 30 is appropriately changed according to the product shape of the press formed product 1, and the employable processing method is also appropriately changed according to the product shape of the press formed product 1.

Figure 10:
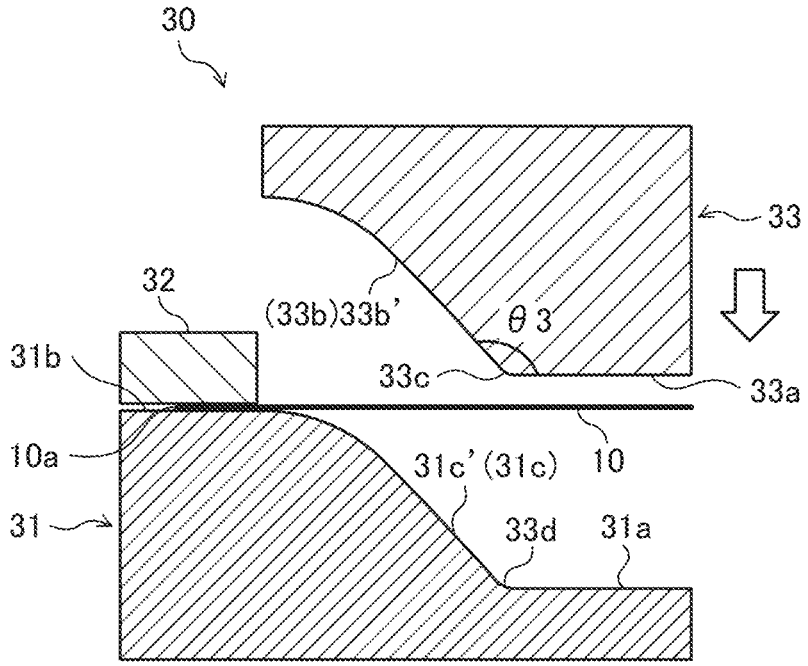
FIG. 10 is a view illustrating a forming process of the intermediate formed product in the preforming step.
Figure 10B:
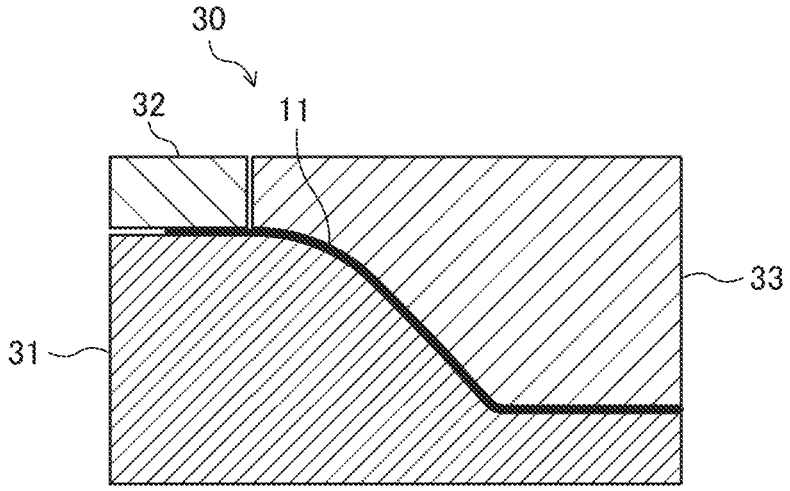

In the preforming step using the preforming apparatus 30, the blank 10 around the cutout part 10*a* is first held down by the preforming pad 32 as in FIG. 7 and FIG. 10(*a*), and the preforming die 33 is lowered in this state. Note that as in FIG. 10(*a*), the periphery of the cutout part 10*a* of the blank 10 is sandwiched between the preforming punch ceiling face part 31*b* and the lower face of the preforming pad 32, whereby the blank 10 can be placed between the upper face of the preforming punch 31 and the lower face of the preforming die 33.

Thus, the blank 10 is placed between the upper face of the preforming punch 31 and the lower face of the preforming die 33, and the preforming die 33 is lowered as in FIG. 10(*b*). At a forming bottom dead center where the preforming die 33 is lowered, the preforming punch vertical wall part 31*c*' and the preforming die vertical wall part 33*b*' are oppositely adjacent to each other, and the preforming punch bottom face part 31*a* and the preforming die bottom face part 33*a* are oppositely adjacent to each other. Further, at the forming bottom dead center where the preforming die 33 is lowered, the preforming die shoulder ridgeline part 33*c* and the concave ridgeline part 31*d* are brought into a state of extending while being convexly curved in a direction from the preforming punch vertical wall part 31*c*' toward the preforming die vertical wall part 33*b*' in plan view viewed in the press direction.

Figure 11:
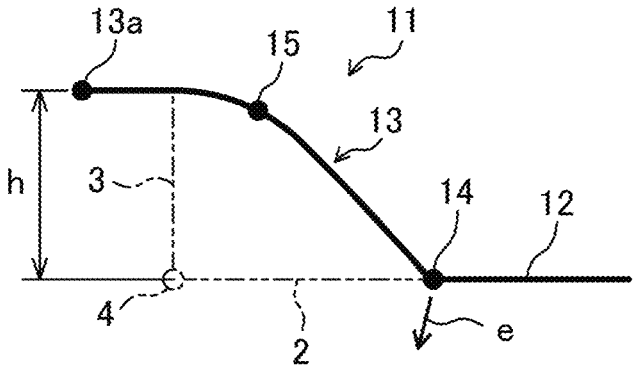
FIG. 11 is a view illustrating a cross section along A-A in FIG. 5(*b*). Note that a two-dotted chain line in FIG. 11 indicates the shape of the press formed product after a flange forming step.

When the preforming die 33 lowers down to the forming bottom dead center, a partial region of the blank 10 is press formed by the preforming punch vertical wall part 31*c*' of the preforming punch 31 and the preforming die vertical wall part 33*b*' of the preforming die 33 to form into a shape raised as in FIG. 10(*b*), and the intermediate formed product 11 having the first face 12, the raised face 13, and the first ridgeline 14 is formed as illustrated in FIG. 11. The raised face 13 is formed by folding upward a part of the flat plate-shaped face 12 by the press forming in the preforming step. In the intermediate formed product 11, the first ridgeline 14 continuously exists between the first face 12 and the raised face 13. In plan view viewed in the press direction, the first ridgeline 14 exists in a curved line shape convexly curved in a direction from the raised face 13 toward the first face 12. Further, in the cross section in the press direction intersecting with the first ridgeline 14, the first ridgeline 14 projects obliquely downward (indicated by an arrow e in FIG. 11). The height of the raised face 13 is the height in the plate thickness direction of the first face from the first face 12.

Figure 12:
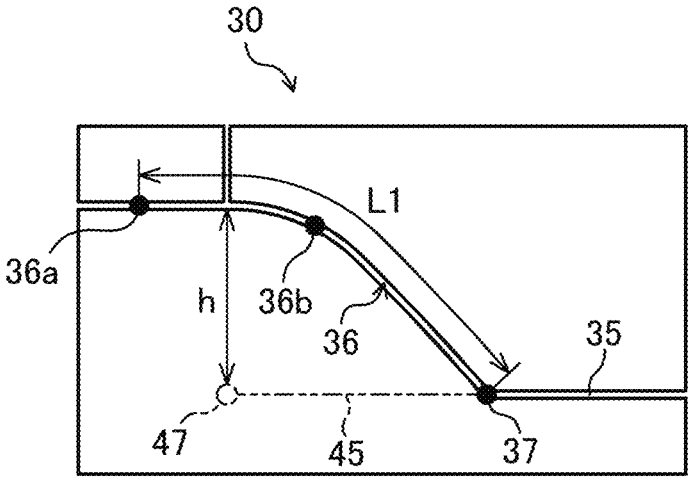
FIG. 12 is a chart for explaining forming parts of the preforming apparatus. In the drawing, an illustration of hatching indicating the cross section is omitted.

The first face 12, the raised face 13, and the first ridgeline 14 of the intermediate formed product 11 are formed by the preforming apparatus 30 as in the above, and therefore the preforming apparatus 30 has a first face forming part 35 being a portion which forms the first face 12 of the intermediate formed product 11, a raised face forming part 36 being a portion which is raised with respect to the first face forming part 35 and forms the raised face of the intermediate formed product 11, and a first ridgeline forming part 37 being a portion which connects the first face forming part 35 and the raised face forming part 36 and forms the first ridgeline 14 of the intermediate formed product 11, as illustrated in FIG. 12. A gap between the preforming punch bottom face part 31*a* of the preforming punch 31 and the preforming die bottom face part 33*a* of the preforming pad 32 is the first face forming part 35. A gap between the preforming punch vertical wall part 31*c*' of the preforming punch 31 and the preforming die vertical wall part 33*b*' of the preforming pad 32 is the raised face forming part 36. A gap between the concave ridgeline part 31*d* of the preforming punch 31 and the preforming die shoulder ridgeline part 33*c* of the preforming die 33 is the first ridgeline forming part 37. Further, the first face 12 having a part of a rim, which is adjacent to the first ridgeline 14 and curved to the inside of the first face 12 as in FIG. 5(*b*), is formed by the first face forming part 35, and therefore the first face forming part 35 has a portion where a part of a rim adjacent to the first ridgeline forming part 37 is curved to the inside of the first face forming part 35, and the raised face forming part 36 is provided adjacent to the curved portion of the first face forming part 35. In short, the first ridgeline forming part 37 is located between the raised face forming part 36 and the first face forming part 35.

In the preforming step as illustrated in FIG. 11, the raised face 13 of the intermediate formed product 11 is formed to include a part 15 which will become the ridgeline 4 in the subsequent flange forming step. In this description, the portion which will become the ridgeline 4 in the subsequent flange step is called a "ridgeline-corresponding part 15" as a portion corresponding to the ridgeline 4. In other words, the raised face 13 of the intermediate formed product 11 is formed to include the ridgeline-corresponding part 15. Note that the position of the ridgeline-corresponding part 15 changes according to the product shape of the press formed product 1, the height of the flange 3, the intermediate product shape (shape or the like of the raised face 13) or the like. Further, what range of the blank 10 is raised when forming the raised face 13 including the ridgeline-corresponding part 15 is appropriately changed according to the product shape of the press formed product 1, the form configuration or the like. In other words, the ratio between the first face 12 and the raised face 13 in the intermediate formed product 11 is appropriately changed according to the product shape of the press formed product 1, the form configuration or the like <Flange Forming Step>

As illustrated in FIG. 5(*c*), the press formed product 1 manufactured in the flange forming step has, as explained above, the flat plate-shaped face 2 (hereinafter, referred to as a "second face 2"), the flange 3 curved in the direction (upward) intersecting with the second face 2, and the ridgeline 4 (hereinafter, referred to as a "second ridgeline 4") connecting the second face 2 and the flange 3. In plan view viewed in the press direction, the second ridgeline 4 extends while being convexly curved in a direction from the flange 3 toward the second face 2. Note that, as will be explained later, the first ridgeline 14 of the intermediate formed product 11 is spread out and substantially disappears in the flange forming step. However, the first ridgeline 14 may be crushed and become a trace of the first ridgeline, or an angle formed by the first face 12 and the second face 2 made by deforming the raised face 13 may increase to leave the first ridgeline 14. In FIG. 5, the trace of the first ridgeline (14) is illustrated. Even if the trace of the first ridgeline is flat, the trace can be identified, for example, by polishing the surface of the product with a file or measuring the hardness to investigate a processed and hardened portion.

Figure 13:
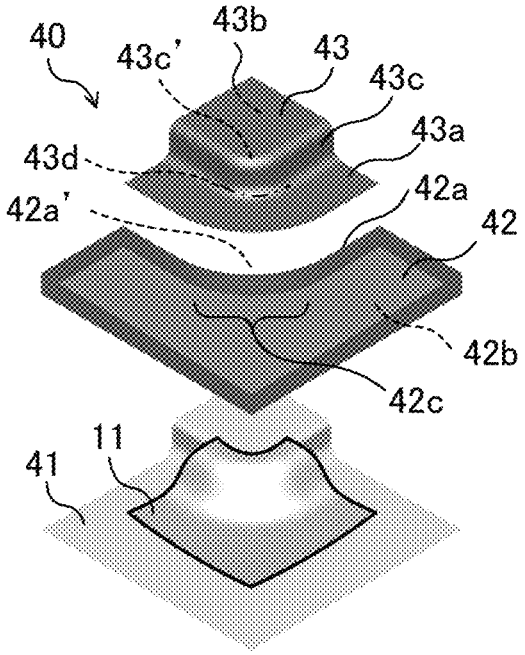
FIG. 13 is a view illustrating a configuration example of the press forming apparatus in the flange forming step.
Figure 14:
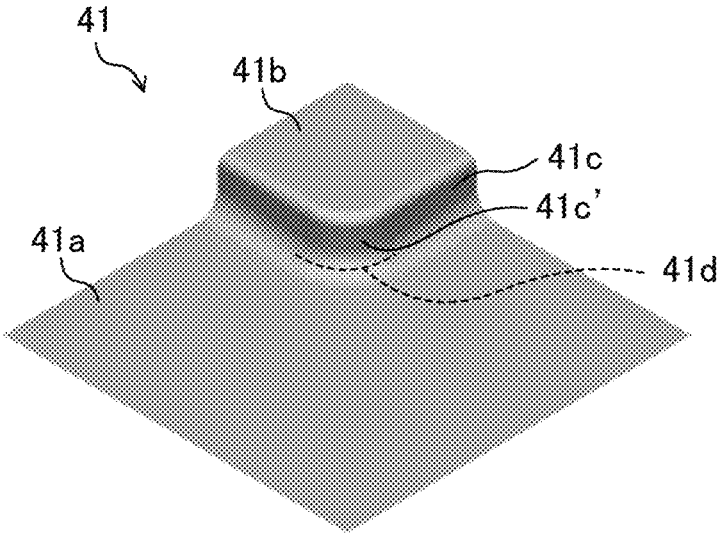
FIG. 14 is a view illustrating the punch of the press forming apparatus.
Figure 15:
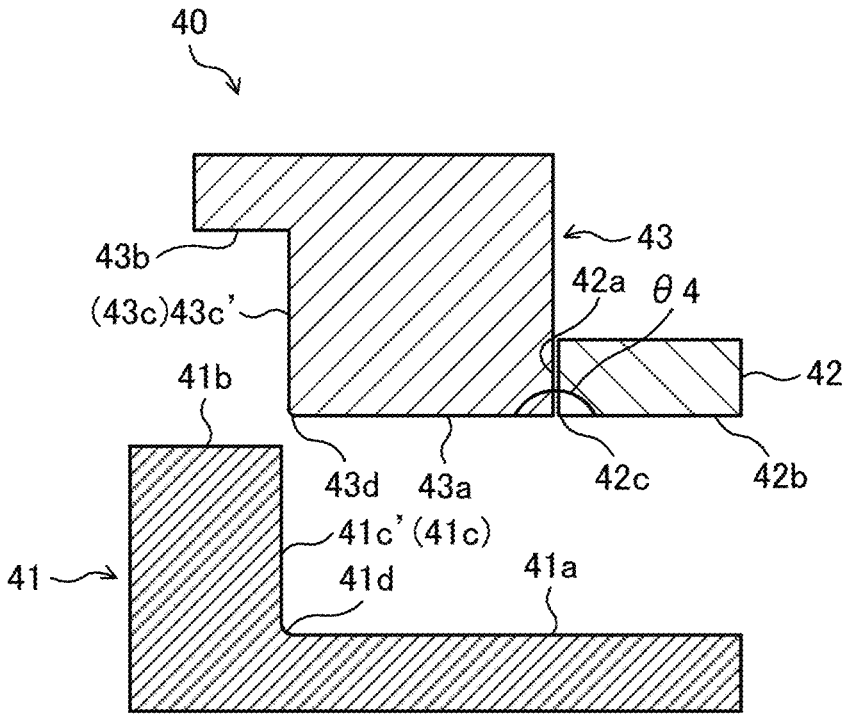
FIG. 15 is a view illustrating a cross section in the press direction of the press forming apparatus.

In the flange forming step in this embodiment, the press forming apparatus 40 having the configuration illustrated, for example, in FIG. 13 to FIG. 15 forms the intermediate formed product 11 to manufacture the press formed product 1. Note that FIG. 13 illustrates only a lower face shape of a die 43. Further, FIG. 13 and FIG. 14 illustrate only an upper face shape of a punch 41. The upper face of the punch 41 and the lower face of the die 43 are press faces (forming parts) which form the press formed product 1 from the intermediate formed product 11.

As illustrated in FIG. 15, the press forming apparatus 40 in this embodiment includes the punch 41, the pad 42, and the die 43. The punch 41 has a punch bottom face part 41*a*, a punch ceiling face part 41*b* located at a height different from that of the punch bottom face part 41*a* (above the punch bottom face part 41*a* in this embodiment), and a punch vertical wall face 41*c* which connects the punch bottom face part 41*a* and the punch ceiling face part 41*b*. The punch bottom face part 41*a* and the punch ceiling face part 41*b* of the punch 41 in this embodiment are parallel to each other but do not need to be parallel. Further, a part of the punch vertical wall face 41*c* is a punch vertical wall part 41*c*' having a curvature like a side face of a circular cylinder as illustrated in FIG. 13. The punch vertical wall part 41*c*' has a curved line shape convex in a direction from the punch ceiling face part 41*b* to the punch bottom face part 41*a* in plan view viewed in the press direction. In short, the surface of the punch vertical wall part 41*c*' is convexly curved. Further, a portion between the punch bottom face part 41*a* and the punch vertical wall part 41*c*' is a punch concave ridgeline part 41*d*. Similarly, the punch concave ridgeline part 41*d* has a curved line shape convex in a direction from the punch ceiling face part 41*b* toward the punch bottom face part 41 a in plan view viewed in the press direction.

The pad 42 has a pad vertical wall face 42*a* and a pad bottom face part 42*b*. The lower face of the pad 42 is the pad bottom face part 42*b*. The pad vertical wall face 42*a* is formed to face the die 43. A part of the pad vertical wall face 42*a* is a pad vertical wall part 42*a*' having a curvature concave from the die 43 toward the pad 42. The pad vertical wall part 42*a*' has a curved line shape convex in a direction from the pad vertical wall face 42*a* toward the pad bottom face part 42*b* in plan view viewed in the press direction. Further, between the pad bottom face part 42*b* and the pad vertical wall part 42*a*', a pad ridgeline part 42*c* exists. Similarly, the pad ridgeline part 42*c* has a curved line shape convex in a direction from the die 43 toward the pad 42 in plan view viewed in the press direction. The pad vertical wall part 42*a*' is arranged adjacent to the die 43, and the pad 42 is configured to be able to rise and lower at a position opposite to the punch bottom face part 41*a* of the punch 41.

The die 43 has a die bottom face part 43*a* opposite to the punch bottom face part 41*a*, a die ceiling face part 43*b* opposite to the punch ceiling face part 41*b*, and a die vertical wall face 43*c* opposite to the punch vertical wall face 41*c*, and is configured to be able to rise and lower at a position between the punch vertical wall face 41*c* and the pad 42. The die bottom face part 43*a* and the die ceiling face part 43*b* of the die 43 in this embodiment are parallel to each other but do not need to be parallel. Further, a part of the die vertical wall face 43*c* is a die vertical wall part 43*c*' having a curvature concave toward the inside of the die 43. The die vertical wall part 43*c*' has a curved shape convex in a direction from the die ceiling face part 43*b* toward the die bottom face part 43*a* in plan view viewed in the press direction. Further, between the die bottom face part 43*a* and the die vertical wall part 43*c*', a die shoulder ridgeline part 43*d* exists. Similarly, the die shoulder ridgeline part 43*d* has a curved line shape convex in a direction from the die ceiling face part 43*b* toward the die bottom face part 43*a* in plan view viewed in the press direction. Note that the configuration of the press forming apparatus 40 is appropriately changed according to the product shape of the press formed product 1, and the employable processing method is also appropriately changed according to the product shape of the press formed product 1.

Figure 16A:
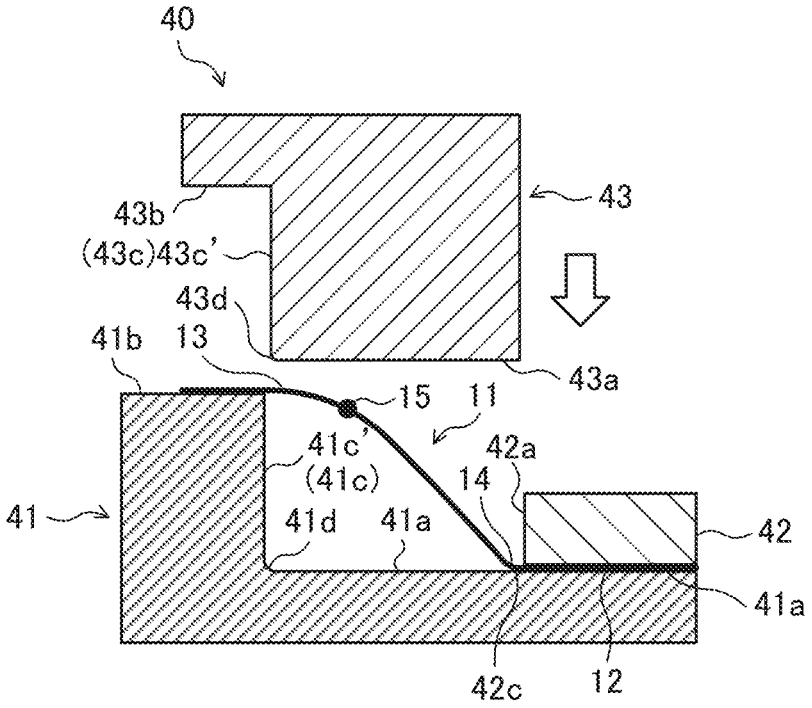
FIG. 16 is a view illustrating a forming process of the press formed product in the flange forming step.
Figure 16B:
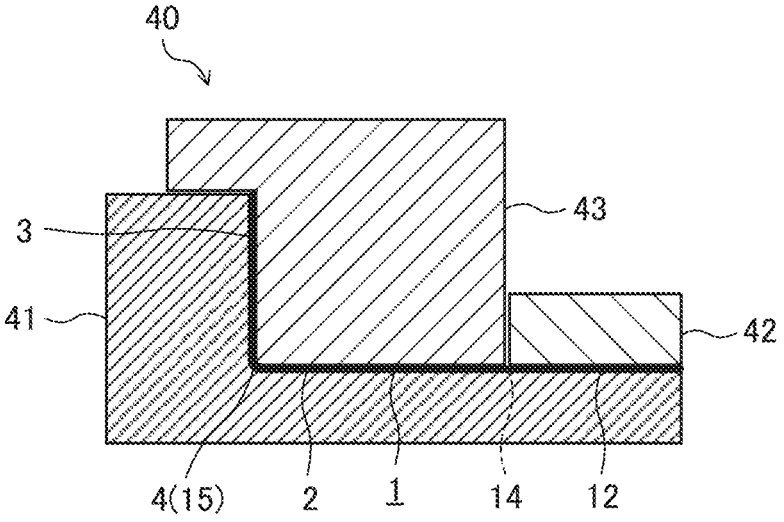

In the flange forming step using the press forming apparatus 40, the first face 12 of the intermediate formed product 11 is first held down by the pad 42 as in FIG. 16(*a*), and the die 43 is lowered in this state, thereby processing it in a manner to push in the raised face 13 from the outside of bending of the raised face 13 to the inside of bending. Note that as in FIG. 16(*a*), the first face 12 of the intermediate formed product 11 is sandwiched between the pad bottom face part 42*b* and the punch bottom face part 41*a*, whereby the intermediate formed product 11 can be placed between the upper face of the punch 41 and the lower face of the die 43.

Thus, the intermediate formed product 11 is placed between the upper face of the punch 41 and the lower face of the die 43, and the die 43 is lowered as in FIG. 16(*b*). At a forming bottom dead center where the die 43 is lowered, the punch vertical wall part 41*c*' and the die vertical wall part 43*c*' are oppositely adjacent to each other, the punch bottom face part 41*a* and the die bottom face part 43*a* are oppositely adjacent to each other, and the pad bottom face part 42*b* and the punch bottom face part 41*a* are oppositely adjacent to each other. Further, at the forming bottom dead center where the die 43 is lowered, the die shoulder ridgeline part 43*d* extends while being convexly curved in a direction from the punch vertical wall part 41*c*' toward the die vertical wall part 43*c*', and the pad ridgeline part 42*c* extends while being convexly curved in a direction from the die 43 toward the pad 42 in plan view viewed in the press direction.

When the die 43 lowers down to the forming bottom dead center, the intermediate formed product 11 is press formed by the punch vertical wall part 41*c*' of the punch 41 and the die vertical wall part 43*c*' of the die 43. As a result, as in FIG. 16(*b*), a part of the raised face 13 of the intermediate formed product 11 becomes a face continuous to the first face 12 of the intermediate formed product 11, whereby the second face 2 is formed as the press formed product 1 as in FIG. 17. With the above, the first ridgeline 14 of the intermediate formed product 11 may be spread out and disappear. The first ridgeline 14 does not need to be completely spread out but may remain. Even if the first ridgeline 14 disappears, a trace of the first ridgeline 14 sometimes remains. Besides, at a remaining portion of the raised face 13, a material flows into a gap between the punch vertical wall part 41*c*' of the punch 41 and the die vertical wall part 43*c*' of the die 43, so that the ridgeline-corresponding part 15 of the intermediate formed product 11 becomes the second ridgeline 4 and a tip 13*a* of the raised face 13 becomes a tip 3*a* of the flange 3, whereby the flange 3 is formed as in FIG. 17. In the press formed product 1, the first ridgeline 4 continuously exists between the second face 2 and the flange 3. In plan view viewed in the press direction, the second ridgeline 4 extends in a curved line shape convexly curved in a direction from the flange 3 to the second face 2. Besides, in the cross section along the press direction intersecting with the second ridgeline 4, the second ridgeline 4 projects obliquely downward (indicated by an arrow f in FIG. 17). In other words, the direction in which the first ridgeline 14 projects (indicated by the arrow e in FIG. 11) in the cross section in the press direction intersecting with the first ridgeline 14 in the intermediate formed product 11 and the direction in which the second ridgeline 4 projects (indicated by the arrow f in FIG. 17) in the cross section in the press direction intersecting with the second ridgeline 4 in the press formed product 1 are on the same face side of the intermediate formed product 11 and the press formed product 1.

Figure 17:
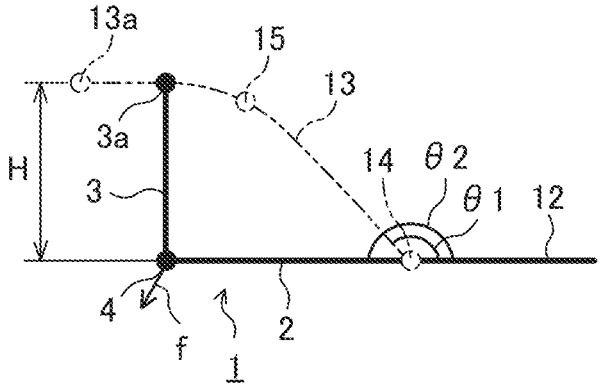
FIG. 17 is a view illustrating a cross section along B-B in FIG. 5(*c*). Note that a two-dotted chain line in FIG. 17 indicates the shape of the intermediate formed product after the preforming step.
Figure 18:
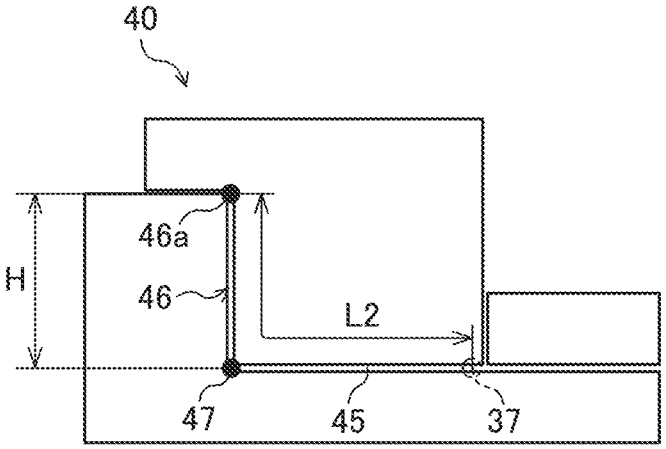
FIG. 18 is a chart for explaining forming parts of the press forming apparatus. In the drawing, an illustration of hatching indicating the cross section is omitted.

As explained above, the second face 2, the flange 3, and the second ridgeline 4 of the press formed product 1 are formed by the press forming apparatus 40, and therefore the press forming apparatus 40 has a second face forming part 45 being a portion which forms the second face 2 of the press formed product 1, a flange forming part 46 being a portion which forms the flange 3 of the press formed product 1, and a second ridgeline forming part 47 being a portion which forms the second ridgeline 4 of the press formed product 1 as illustrated in FIG. 18. A gap between the punch bottom face part 41*a* of the punch 41 and the die bottom face part 43*a* of the die 43 is the second face forming part 45, a gap between the punch vertical wall part 41*c*' of the punch 41 and the die vertical wall part 43*c*' of the die 43 is the flange forming part 46, and a gap between the punch concave ridgeline part 41*d* of the punch 41 and the die shoulder ridgeline part 43*d* of the die 43 is the second ridgeline forming part 47. Further, the second face 2 having a part of a rim, which is adjacent to the second ridgeline and extends while being curved to the inside of the second face 2 as in FIG. 5(*c*), is formed by the second face forming part 45, and therefore the second face forming part 45 has a portion where a part of a rim is curved to the inside of the second face forming part 45, and the flange forming part 46 is provided at the curved portion of the second face forming part 45. Since the flange 3 of the press formed product 1 is formed by the flange forming part 46, a height H (FIG. 18) of the flange forming part 46 may be equal to a height H (FIG. 17) of the flange 3. Note that when the height of the forming part 46 is equal to or larger than the height of the flange 3, there is no problem in terms of a form.

As explained above, in the flange forming step using the press forming apparatus 40, a part of the raised face 13 of the intermediate formed product 11 becomes a face continuous to the first face 12 of the intermediate formed product 11, whereby the second face 2 as the press formed product 1 is formed as in FIG. 17. With the above, the first ridgeline 14 of the intermediate formed product 11 is spread out and the first ridgeline 14 may disappear. However, the first ridgeline 14 of the intermediate formed product 11 does need to be spread out into a complete flat-plate shape (180°) in the press formed product 1. In comparison of the cross section in the press direction intersecting with the first ridgeline 14 before and after the flange forming step, an angle formed by the second face 2 at a position corresponding to the first ridgeline 14 (portion corresponding to the first ridgeline 14 existing in the intermediate formed product) (angle formed by adjacently existing portions of the second face 2 at the position corresponding to the first ridgeline 14) (02) in the press formed product 1 (after the flange forming step) only needs to be larger than an angle formed by the raised face 13 and the first face 12 which exist adjacent to the first ridgeline 14 (01) in the intermediate formed product 11 (before the flange forming step) as illustrated in FIG. 17. As in the above, the first ridgeline 14 existing in the intermediate formed product is spread out in the flange forming step and thereby may become a part of the second face 2 in the press formed product 1. Note that the first ridgeline 14 between the first face 12 and the second face may keep the shape in the extending direction of the ridgeline or may become a trace of the first ridgeline 14.

The press formed product 1 having the stretch flange part in this embodiment is manufactured through the above steps. Thus manufactured press formed product 1 has reduced tensile strain occurring at a tip portion of the flange 3. Its reason will be explained below.

Figure 19:
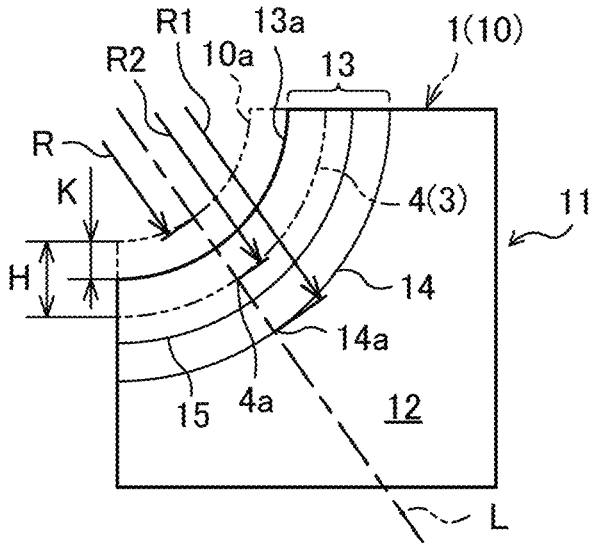
FIG. 19 is a plan view of the intermediate formed product.

FIG. 19 is a view of the intermediate formed product 11 after the preforming step viewed in the press direction (view from above). Note that, in FIG. 19, the shape of the blank 10 and the press formed product 1 after the flange forming step are illustrated for comparison. In FIG. 19, the position of the blank 10 is fixed, and the positional relation between the first face 12, the raised face 13, and the first ridgeline 14 which appear in the intermediate formed product 11, and, the second face 2, the flange 3, and the second ridgeline 4 which appear in the press formed product 1, when processing the intermediate formed product 11 and the press formed product 1 in this order from the same blank 10 is illustrated in comparison. The cutout part 10*a* of the blank 10 and the second ridgeline 4 of the press formed product 1 are indicated by two-dotted chain lines. Further, in the press formed product 1 in this embodiment, when the flange 3 is in a shape extending in a direction perpendicular to the second face 2 as in FIG. 17, the position of the flange 3 and the position of the second ridgeline 4 are at almost the same position in plan view as in FIG. 19.

Further, in FIG. 19, for comparing the curvatures in the extending direction of the first ridgeline 14 appearing in the intermediate formed product 11 and the second ridgeline 4 appearing in the press formed product 1, a straight line L intersecting with the first ridgeline 14 of the intermediate formed product 11 and orthogonal to the second ridgeline 4 of the press formed product 1 is illustrated. A curvature radius R1 in the extending direction of the first ridgeline 14 at an intersection 14*a* of the straight line L and the first ridgeline 14 and a curvature radius R2 in the extending direction of the second ridgeline 4 at an intersection 4*a* of the straight line L and the second ridgeline 4 are compared.

As illustrated in FIG. 19, when the curvature radius in plan view of the cutout part 10*a* at the intersection of the straight line L and the cutout part 10*a* of the blank 10 is R and the height of the flange 3 after flange forming is H, a strain $\varepsilon_1$ in the circumferential direction occurring at the tip of the flange 3, for example, when the flange 3 is formed from the blank 10 in one step can be expressed by the following expression. Note that the "one step" means that the press formed product 1 is press formed from the blank 10 in a single step.

$$\varepsilon_1 = \{(R+H)\times\pi\times(1/4) - R\times\pi\times(1/4)\}/\{R\times\pi\times(1/4)\} = H/R$$

On the other hand, when forming the press formed product 1 through the preforming step from the blank 10, a curvature radius R+K in plan view of the raised face tip 13*a* of the intermediate formed product 11 is larger than the curvature radius R in plan view of the cutout part 10*a* of the blank 10 in the preforming step. In this case, a strain $\varepsilon_2$ in the circumferential direction occurring at the tip of the flange 3 when the flange 3 is formed from the intermediate formed product 11 as in this embodiment can be expressed by the following expression. Note that the "K" in the following expression is a difference between the curvature radius of the tip 13*a* of the raised face 13 and the curvature radius of the cutout part 10*a* of the blank 10.

$$\varepsilon_2 = \{(R+H)\times\pi\times(1/4) - (R+K)\times\pi\times(1/4)\}/\{(R+K)\times\pi\times(1/4)\} = (H-K)/R+K$$

Comparing the above $\varepsilon_1$ and $\varepsilon_2$, the value of a numerator of $\varepsilon_2$ is smaller by K than the value of a numerator of $\varepsilon_1$ and the value of a denominator of $\varepsilon_2$ is larger by K than the value of a denominator of $\varepsilon_1$. In short, since $\varepsilon_2$ is smaller than $\varepsilon_1$, the strain occurring at the tip portion of the flange 3 is smaller in the case of forming the flange 3 by performing the preforming step as in this embodiment. Further, in the process of forming the flange 3 from the raised face 13 in the flange forming step, a line length in the circumferential direction at the periphery of the second ridgeline 4 of the press formed product 1 becomes short. Therefore, the material is excessive at the periphery of the second ridgeline 4 of the press formed product 1, and the material is likely to flow toward the tip side of the flange 3 in the flange forming step. This suppresses the tensile strain at the tip portion of the flange 3.

Therefore, according to the manufacturing method of performing the preforming step of forming the raised face 13 as in this embodiment, it is possible to manufacture the press formed product 1 having the stretch flange part while suppressing the tensile strain at the tip portion of the flange 3. This makes it possible to lower the difficulty of forming the press formed product 1 having the stretch flange part and to form a component in a desired shape even if the material of the component has higher strength.

To obtain the effect of suppressing the tensile strain at the tip portion of the flange 3 as in the above, it is necessary to perform press forming so that the curvature radius R1 in plan view of the first ridgeline 14 of the intermediate formed product 11 (curvature radius R1 in the extending direction of the first ridgeline 14 at the intersection 14*a* with the straight line L in the intermediate formed product 11) becomes larger than the curvature radius R2 in plan view of the second ridgeline 4 of the press formed product 1 (curvature radius R2 in the extending direction of the second ridgeline 4 at the intersection 4*a* with the straight line L in the press formed product 1 after the flange forming step). By performing the press forming, the curvature radius R+K in plan view of the raised face tip 13*a* becomes larger than the curvature radius R in plan view of the cutout part 10*a* of the blank 10, and the ridgeline-corresponding part 15 is included in the raised face 13. To obtain the effect of suppressing the tensile strain at the tip portion of the flange 3, the press forming line 20 needs to have the curvature radius R1 of the first ridgeline forming part 37 of the preforming apparatus 30 larger than the curvature radius R2 of the second ridgeline forming part 47 of the press forming apparatus 40 in a state from the press direction.

Figure 20:
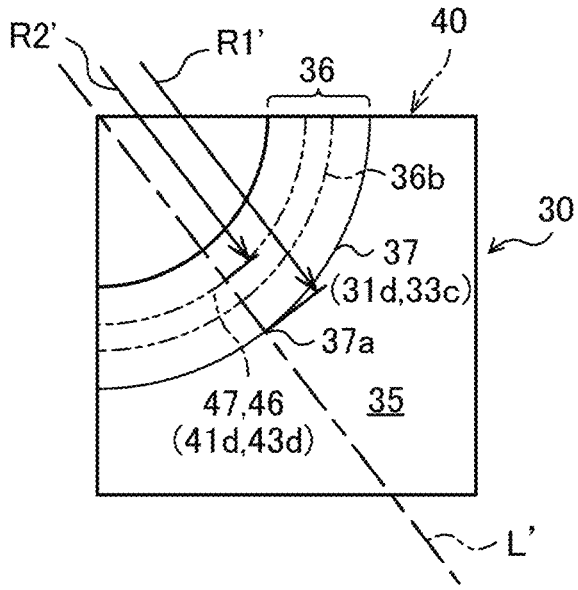
FIG. 20 is a plan view schematically illustrating the forming parts of the press forming apparatus.
Figure 21A:
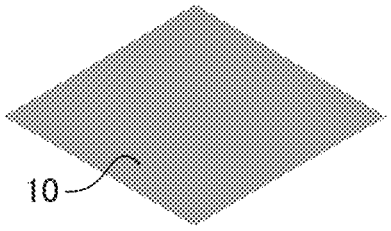
FIG. 21 is a view illustrating a component shape in a manufacturing process of a press formed product having a stretch flange part according to another embodiment of the present invention, (a) illustrating the shape of a blank, (b) illustrating the shape of an intermediate formed product after a preforming step, (c) illustrating the shape of a press formed product after a trim step, and (d) illustrating the shape of the press formed product after a flange forming step.
Figure 21B:
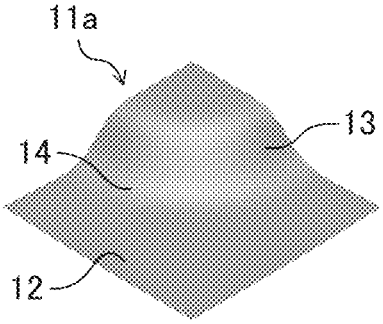
Figure 21C:
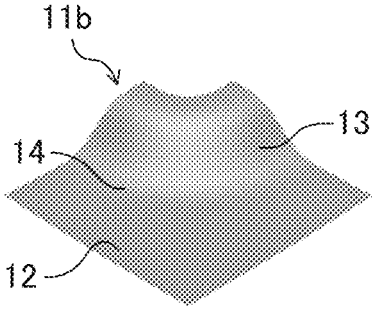
Figure 21D:
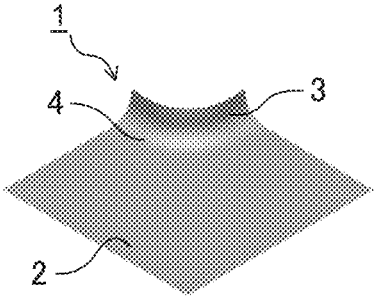

FIG. 20 is a plan view schematically illustrating the first face forming part 35, the raised face forming part 36, and the first ridgeline forming part 37 of the preforming apparatus 30. Note that in FIG. 20, the second face forming part 45, the flange forming part 46, and the second ridgeline forming part 47 of the press forming apparatus 40 are indicated by two-dotted chain lines at corresponding portions. Here, the corresponding portions mean that the positional relation among the punch 31, the pad 32, and the die 33 of the preforming apparatus 30 which press forms the intermediate formed product 11, and, the positional relation among the punch 41, the pad 42, and the die 43 of the press forming apparatus 40 which further press forms the intermediate formed product 11 into the press formed product 1, when the press forming apparatus 40 further press forms the intermediate formed product 11 which has been press formed by the preforming apparatus 30, to manufacture the press formed product 1. In the press forming apparatus 40 in this embodiment, when the flange 3 formed by the flange forming part 46 has a shape extending in the direction perpendicular to the second face 2, the flange forming part 46 and the second ridgeline forming part 47 are at almost the same position in plan view as in FIG. 20.

The first ridgeline forming part 37 is formed between the concave ridgeline part 31*d* of the preforming punch 31 and the preforming die shoulder ridgeline part 33*c* of the preforming die 33. The second ridgeline forming part 47 is formed between the punch concave ridgeline part 41*d* of the punch 41 and the die shoulder ridgeline part 43*d* of the die 43.

Further, in FIG. 20, to compare the curvature radii in the extending direction of the first ridgeline forming part 37 (the concave ridgeline part 31*d* of the preforming punch 31 and the preforming die shoulder ridgeline part 33*c* of the preforming die 33) and the second ridgeline forming part 47 (the punch concave ridgeline part 41*d* of the punch 41 and the die shoulder ridgeline part 43*d* of the die 43), a common straight line L' intersecting with the preforming die shoulder ridgeline part 33*c* (concave ridgeline part 31*d*) and orthogonal to the die shoulder ridgeline part 43*d* (punch concave ridgeline part 41*d*) is illustrated as in FIG. 19. A curvature radius R1' in the extending direction of the preforming die shoulder ridgeline part 33*c* (concave ridgeline part 31*d*) at an intersection 37*a* of the straight line L' and the preforming die shoulder ridgeline part 33*c* (concave ridgeline part 31*d*) and a curvature radius R2' in the extending direction of the die shoulder ridgeline part 43*d* (punch concave ridgeline part 41*d*) at an intersection 47*a* of the straight line L' and the die shoulder ridgeline part 43*d* (punch concave ridgeline part 41*d*) are compared.

Here, the second ridgeline forming part 47 is a portion which forms the second ridgeline 4 of the press formed product 1, and the curvature radius R2' in the extending direction of the die shoulder ridgeline part 43*d* (punch concave ridgeline part 41*d*) inevitably coincides with the curvature radius R2 in plan view viewed from the press direction in press forming the second ridgeline 4 of the press formed product 1. Besides, the first ridgeline forming part 37 is a portion which forms the first ridgeline 14 of the intermediate formed product 11, and the curvature radius R1' in the extending direction of the preforming die shoulder ridgeline part 33*c* (concave ridgeline part 31*d*) inevitably coincides with the curvature radius R1 in plan view of the first ridgeline 14 of the intermediate formed product 11. Accordingly, as with the above, to obtain the effect of suppressing the tensile strain at the tip portion of the flange 3, the curvature radius R1' in the extending direction of the preforming die shoulder ridgeline part 33*c* (concave ridgeline part 31*d*) needs to be larger than the curvature radius R2' in the extending direction of the die shoulder ridgeline part 43*d* (punch concave ridgeline part 41*d*).

Further, in the flange forming step, the first face 12 of the intermediate formed product 11 is held down by the pad 42 as illustrated in FIG. 16(*a*), and the die 43 is lowered in this state and thereby performs processing in a manner to push in the raised face 13 from the outside of bending of the raised face 13 to the inside of bending in the press forming apparatus 40. In this case, it is desirable to stably constrain the intermediate formed product 11. To this end, it is only necessary to bring the pad bottom face part 42*b* of the pad 42 into contact with the first face 12 of the intermediate formed product 11 at a position as close as possible to the first ridgeline 14. The die 43 is lowered in a state where the pad bottom face part 42*b* of the pad 42 constrains the first face 12 of the intermediate formed product 11 at a position as close as possible to the first ridgeline 14, thereby making it possible to press form the press formed product 1 with high processing accuracy.

To hold the first face 12 of the intermediate formed product 11 at a position as close as possible to the first ridgeline 14 by the pad bottom face part 42*b* of the pad 42, the curvature radius of the pad ridgeline part 42*c* formed in a curved line shape convex in a direction from the die 43 toward the pad 42 only needs to be the same as the curvature radius R1 in plan view of the first ridgeline 14 of the intermediate formed product 11 in plan view viewed in the press direction. When the curvature radius of the pad ridgeline part 42*c* in plan view viewed from the press direction is R1, the press forming can be performed with the first face 12 of the intermediate formed product 11 being constrained by the pad bottom face part 42*b* of the pad 42 to a position directly close to the first ridgeline 14, thereby manufacturing the press formed product 1 without wrinkling. When the curvature radius of the pad ridgeline part 42*c* in plan view is R1, on the straight line intersecting with the pad ridgeline part 42*c* and the die shoulder ridgeline part 43*d* as in FIG. 20, the curvature radius in the extending direction of the pad ridgeline part 42*c* at the intersection with straight line inevitably becomes larger than the curvature radius in the extending direction of the die shoulder ridgeline part 43*d* at the intersection with the straight line.

Note that the curvature radius in the extending direction of the pad ridgeline part 42*c* is made larger than R1 so that when the die 43 is lowered, the first ridgeline 14 of the intermediate formed product 11 may be crushed by the die bottom face part 43*a* of the die 43. Also in this case, the relation that the curvature radius in the extending direction of the pad ridgeline part 42*c* is larger than the curvature radius in the extending direction of the die shoulder ridgeline part 43*d* is maintained on the straight line orthogonal to the die shoulder ridgeline part.

Besides, the preforming apparatus 30 and the press forming apparatus 40 are separate apparatuses and the intermediate formed product is not always carried without being changed in orientation between the apparatuses, and therefore it is considered that the positional relation between the first face 12, the raised face 13, and the first ridgeline 14 appearing on the intermediate formed product 11, and, the second face 2, the flange 3, and the second ridgeline 4 appearing on the press formed product 1 is displaced in some cases. In consideration of this case, such a relation may be made that the average value of the curvature radius in the extending direction of the pad ridgeline part 42*c* is larger than the average value of the curvature radius in the extending direction of the die shoulder ridgeline part 43*d*. For example, in plan view viewed in the press direction, the curvature radius of the pad ridgeline part 42*c* formed in a curved line shape convex in a direction from the die 43 toward the pad 42 is measured at a plurality of places (for example, ten places) at regular intervals, and the average value of eight measured values after excluding the highest value and the lowest value can be regarded as the curvature radius of the pad ridgeline part 42*c*. Further, in plan view viewed in the press direction, the curvature radius of the die shoulder ridgeline part 43*d* formed in a curved line shape convex in a direction from the die ceiling face part 43*b* toward the die bottom face part 43*a* is measured at a plurality of places (for example, ten places) at regular intervals, and the average value of eight measured values after excluding the highest value and the lowest value can be similarly regarded as the curvature radius of the die shoulder ridgeline part 43*d*. Thus measured average value of the curvature radius of the pad ridgeline part 42*c* only needs to be larger than the average value of the curvature radius of the die shoulder ridgeline part 43*d*.

Note that the height h (FIG. 12) of the raised face forming part 36 of the preforming apparatus 30 is preferably a height equal to or larger than the height H (FIG. 18) of the flange forming part 46 of the press forming apparatus 40. In other words, the press forming is preferably performed so that the height h (FIG. 11) of the raised face 13 of the intermediate formed product 11 is a height equal to or larger than the height H (FIG. 17) of the flange 3 of the press formed product 1. This makes the first face 12 near the raised face 13 less likely to float when setting the intermediate formed product 11 in the press forming apparatus 40, so that forming can be performed with a more stable posture. The "height h of the raised face forming part 36" in this description is a length from a position in the preforming apparatus 30 corresponding to the second ridgeline forming part 47 of the press forming apparatus 40 to the raised face forming part 36 in a direction perpendicular to the first face forming part 35. Note that in each of the preforming apparatus 30 and the press forming apparatus 40, a position where the formed product (the blank 10 or the intermediate formed product 11) is set is determined in advance, so that the position in the preforming apparatus 30 corresponding to the second ridgeline forming part 47 of the press forming apparatus 40 is unambiguously decided from the contrast between the set positions of the formed products in the preforming apparatus 30 and the press forming apparatus 40.

A length L1 (FIG. 12) from the first ridgeline forming part 37 to a tip 36*a* of the raised face forming part 36 of the preforming apparatus 30 is preferably 1.00 to 1.05 times a length L2 (FIG. 18) from the position corresponding to the first ridgeline forming part 37 of the preforming apparatus 30 to a tip 46*a* of the flange forming part 46 in the press forming apparatus 40. In other words, it is preferable to perform the press forming so that the length from the first ridgeline 14 to the tip 13*a* of the raised face 13 in the intermediate formed product 11 becomes 1.00 to 1.05 times the length from the position corresponding to the first ridgeline 14 of the intermediate formed product 11 to the tip 3*a* of the flange 3 in the press formed product 1. This makes it easier to suppress the occurrence of wrinkling at a base portion of the flange 3. In the viewpoint of improving the effect of suppressing the wrinkling at the base portion of the flange 3, the length L1 is preferably 1.04 times or less the length L2, and more preferably 1.03 times or less. Note that since the position where the formed product (the blank 10 or the intermediate formed product 11) is set is decided in advance in each of the preforming apparatus 30 and the press forming apparatus 40, the position of the tip 36*a* of the raised face forming part 36 in the preforming apparatus 30 and the position in the press forming apparatus 40 corresponding to the first ridgeline forming part 37 of the preforming apparatus 30 are unambiguously decided from the contrast between the set positions of the formed products in the preforming apparatus 30 and the press forming apparatus 40.

Further, as illustrated in FIG. 12, FIG. 13, and FIG. 20, a curvature radius R3 in plan view viewed from the press direction at a position 36*b* where the ridgeline-corresponding part 15 of the intermediate formed product 11 is formed in the raised face forming part 36 of the preforming apparatus 30 is preferably 1.29 times or less the curvature radius R2 in plan view of the second ridgeline forming part 47 of the press forming apparatus 40. In other words, the press forming is preferably performed so that the curvature radius in plan view of the ridgeline-corresponding part 15 of the intermediate formed product 11 is 1.29 times or less the curvature radius in plan view of the second ridgeline 4 of the press formed product 1. This can decrease the wrinkling occurring at the base portion of the flange 3. In the viewpoint of improving the effect of suppressing the wrinkling at the base portion of the flange 3, the curvature radius R3 is preferably 1.28 times or less the curvature radius R2. Note that a preferable lower limit of the ratio between R3 and R2 differs depending on the product shape of the press formed product 1 and therefore is not particularly limited, but the curvature radius R3 is set, for example, to 1.00 times or more the curvature radius R2. Further, since the position where the formed product (the blank 10 or the intermediate formed product 11) is set is decided in advance in each of the preforming apparatus 30 and the press forming apparatus 40, the position 36*b* where the ridgeline-corresponding part 15 of the intermediate formed product 11 is formed in the raised face forming part 36 of the preforming apparatus 30 is unambiguously decided in advance from the contrast between the set positions of the formed products in the preforming apparatus 30 and the press forming apparatus 40.

Besides, as illustrated in FIG. 11, the example in which the raised face 13 of the intermediate formed product 11 is made into an almost linear shape between the first ridgeline 14 and the ridgeline-corresponding part 15 in the cross section along the press direction intersecting with the first ridgeline 14 is illustrated for the intermediate formed product 11 in the illustrated aspect. However, as illustrated in a later-explained example, the raised face 13 of the intermediate formed product 11 may be formed to be a curved line convex toward the preforming punch 31 (convex toward the press direction) in the same cross section. In short, the raised face 13 may form a curved face convex toward the preforming punch 31. In other words, the raised face 13 may include a curved face having an inclination steeper as it goes away from the first face. Note that in the same cross section, when the raised face 13 of the intermediate formed product 11 is made into a curved line convex toward the preforming die 33, a deflection may occur at the second face 2 of the press formed product 1 in the flange forming step.

An example of the embodiment of the present invention has been described above, but the present invention is not limited to the example. It should be understood that various changes and modifications are readily apparent to those skilled in the art within the scope of the technical spirit as set forth in claims, and they should also be covered by the technical scope of the present invention.

For example, the curved line-shaped cutout part 10*a* is provided as an initial shape of the blank 10 in the above embodiment, but even if the cutout part 10*a* is not provided in the blank 10 as in FIG. 21(*a*), the flange 3 can be formed while suppressing the tensile strain. In FIG. 21, a trim step is provided between the preforming step and the flange forming step. The manufacturing method of the press formed product 1 is as follows.

Figure 22:
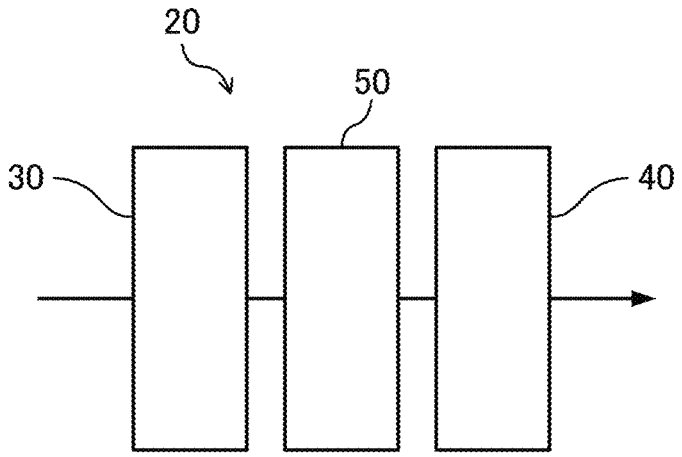
FIG. 22 is a view illustrating an arrangement example of a press forming line.

First, the preforming step forms a raised face 13 as in FIG. 21(*b*) to manufacture a first intermediate formed product 11*a* as in the above embodiment. Next, as illustrated in FIG. 21(*c*), a trim step cuts a tip portion of the raised face 13 based on the product height of the flange 3 so as to obtain the flange 3 with a predetermined height in the flange forming step subsequent thereto to manufacture a second intermediate formed product 11*b*. Finally, the flange forming step forms a flange 3 as in FIG. 21(*d*) from the second intermediate formed product 11*b* as in the above embodiment to manufacture a press formed product 1 having a stretch flange part. The press formed product 1 manufactured by the method is also suppressed in strain at the tip portion of the flange 3. Therefore, the manufacturing method of the press formed product 1 having the stretch flange part is not limited to the method explained in the above embodiment. Note that to perform the trim step as illustrated in FIG. 22, a cutting machine 50 which cuts the tip portion of the raised face 13 of the intermediate formed product 11 is provided, for example, between the preforming apparatus 30 and the press forming apparatus 40 of the press forming line 20. The configuration of the cutting machine 50 is not particularly limited as long as it can cut the tip portion of the raised face 13, and may be configured to shear the tip portion of the raised face 13, for example, by a third press form (not illustrated).

Figure 3:
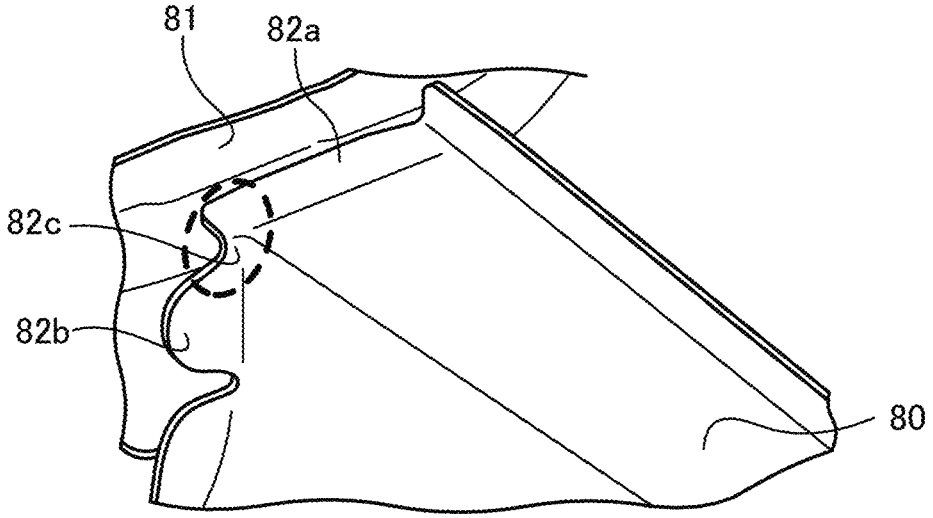
FIG. 3 is a view illustrating an example of a joint shape at a joining part of a first component and a second component.

Further, in this embodiment, the example of press forming the intermediate formed product 11 illustrated in FIG. 5(*b*) and the press formed product 1 illustrated in FIG. 5(*c*) is illustrated. However, both of the shapes of the illustrated intermediate formed product 11 and press formed product 1 are examples. The present invention is also applied, for example, to a case of forming an intermediate formed product into the shape of the press formed product 1 illustrated in FIG. 5(*c*) in the preforming step and bending forming it along a dotted line X illustrated in FIG. 4, thereby forming a joint 82 in which a first flange 82*a* and a second flange 82*b* are continuously connected as illustrated in FIG. 3.

EXAMPLES

<Simulation (1)>

A simulation of forming a component having a stretch flange part was carried out. This simulation is made assuming that a hot-dip galvanized steel plate has a yield point: 510 MPa, a tensile strength: 821 MPa, and an elongation: 22% as a blank and under the condition that a flange is formed with a stretch flange deformation of a curvature radius in plan view of 15 mm and a height of 10 mm. PAM-STAMP is used as an analysis solver, and a mesh size of the blank is 1 mm×1 mm.

Figure 30:
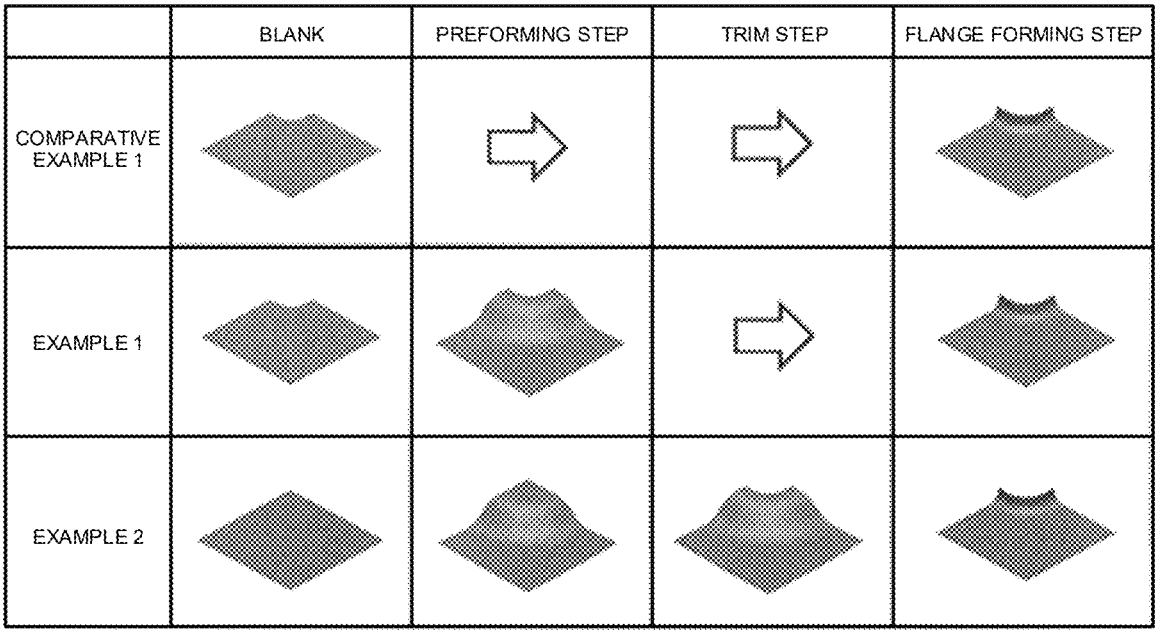
FIG. 30 is a table showing a component shape in each step in each of Examples and Comparative Example.

In this simulation, flanges are formed by a conventional forming method (Comparative Example 1) and forming methods of the present invention examples (Example 1, Example 2), respectively. The forming method in Comparative Example 1 is a method of forming a flange in one step from a blank having a curved line-shaped cutout part. The forming method in Example 1 is a method of forming an intermediate formed product having a raised face in the preforming step on the same blank as that in Comparative Example 1 and forming a flange from the intermediate formed product in the flange forming step. The forming method in Example 2 is a method of forming a first intermediate formed product having a raised face in the preforming step on a blank having no cutout part, cutting a tip portion of the raised face in the rim step to form a second intermediate formed product, and forming a flange from the second intermediate formed product in the flange forming step. In the preforming step in Examples, the intermediate formed product 11 is formed so that the curvature radius R1 (FIG. 19) of the first ridgeline 14 in plan view is larger than the curvature radius R2 of the second ridgeline 4. The component shape in each step in each of Examples and Comparative Example is as in the table depicted in FIG. 30.

Figure 23:
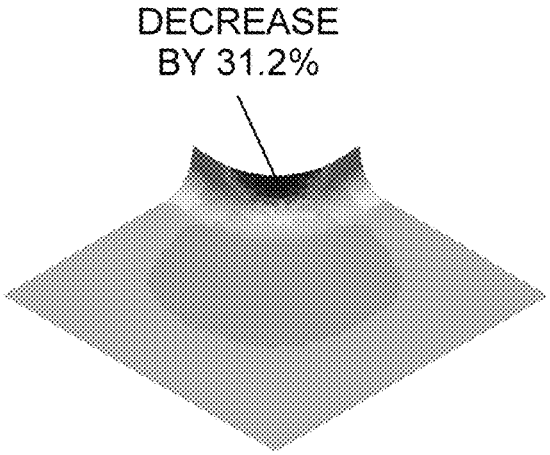
FIG. 23 is a view illustrating the distribution of a plate thickness change of the press formed product after the flange forming step in Comparative Example 1.
Figure 24:
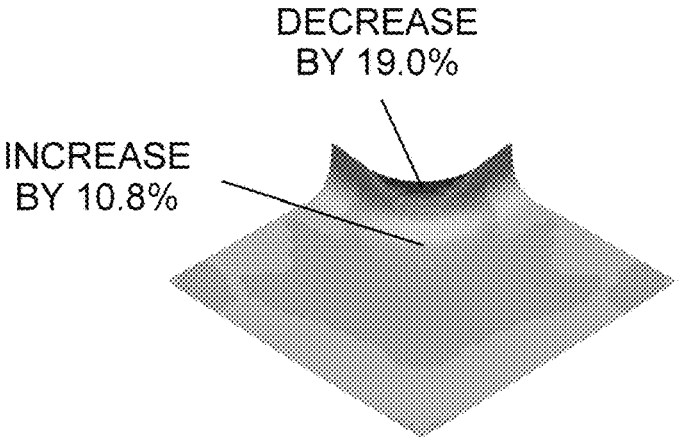
FIG. 24 is a view illustrating the distribution of a plate thickness change of the press formed product after the flange forming step in Example 1.
Figure 25:
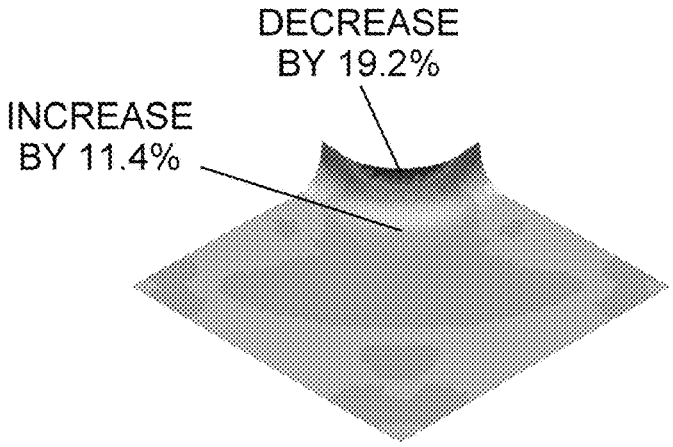
FIG. 25 is a view illustrating the distribution of a plate thickness change of the press formed product after the flange forming step in Example 2.

FIG. 23 to FIG. 25 are views each illustrating the distribution of a plate thickness change of the component after the flange forming for the plate thickness of the blank, and FIG. 23 illustrates the result of Comparative Example 1, FIG. 24 illustrates the result of Example 1, and FIG. 25 illustrates the result of Example 2. As illustrated in FIG. 23, the plate thickness decrease rate at the tip portion of the flange is large in Comparative Example 1, showing that a large stretch flange deformation occurs at the tip portion. On the other hand, as illustrated in FIG. 24 and FIG. 25, the plate thickness decrease rates at the tip portion of the flange are smaller in Example 1 and Example 2 than that in Comparative Example 1, showing that the stretch flange deformation is suppressed.

Figure 26:
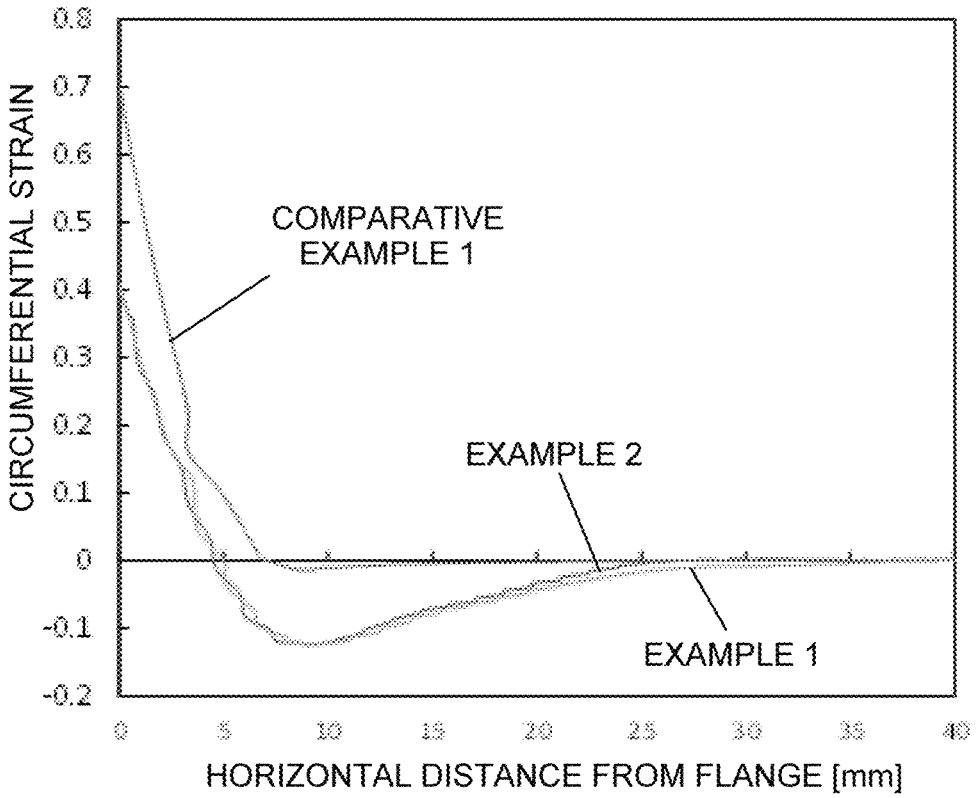
FIG. 26 is a chart illustrating the magnitude of a circumferential strain at a horizontal position from the flange.

FIG. 26 is a chart illustrating the magnitude of a circumferential strain at a horizontal position from the flange. On the vertical axis in FIG. 26, a positive value represents a tensile strain and a negative value represents a compressive strain. As indicated by the result in FIG. 26, the tensile strain at the flange is suppressed in Example 1 and Example 2 as compared with Comparative Example 1.

<Simulation (2)>

A forming simulation was carried out using a plurality of analysis models different in ratio (L1/L2) between the length L1 in the preforming apparatus 30 illustrated in FIG. 12 and the length L2 in the press forming apparatus 40 illustrated in FIG. 18. Note that the raw material and final shape of the blank and the simulation condition of the analysis solver and so on are the same as those in the above simulation (1).

Figure 27:
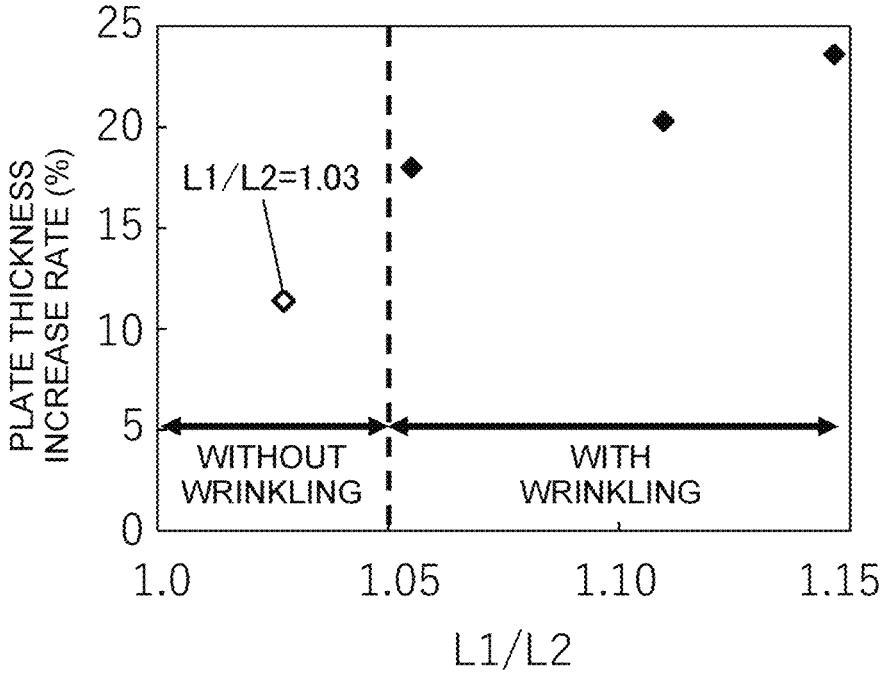
FIG. 27 is a chart illustrating a simulation result of analysis models different in L1/L2.

The simulation result is illustrated in FIG. 27. In this simulation, the presence or absence of occurrence of wrinkling at the flange base portion is inferred from a plate thickness increase rate with the plate thickness increase rate at the flange base portion as an evaluation index. When the plate thickness increase rate at the flange base portion with respect to the plate thickness of the blank exceeds 15%, the material is excess near the flange base portion in forming the flange, thus causing wrinkling at the flange base portion in some cases. As illustrated in FIG. 27, when L1/L2 is 1.05 or less, the plate thickness increase rate is 15% or less, the wrinkling at the flange base portion can be suppressed. Note that in any of the analysis models, the plate thickness decrease rate at the flange tip was less than the plate thickness decrease rate in Comparative Example 1 in the simulation (1). Therefore, by performing the press forming according to the present invention under the condition that L1/L2 is 1.05 or less, it is possible to suppress the tensile strain at the flange tip and suppress wrinkling at the flange base portion.

<Simulation (3)>

A forming simulation was carried out using a plurality of analysis models different in ratio (R3/R2) between the curvature radius R3 of the preforming apparatus 30 and the curvature radius R2 of the press forming apparatus 40 illustrated in FIG. 20. Note that the material and final shape of the blank and the simulation condition of the analysis solver and so on are the same as those in the above simulation (1).

Figure 28:
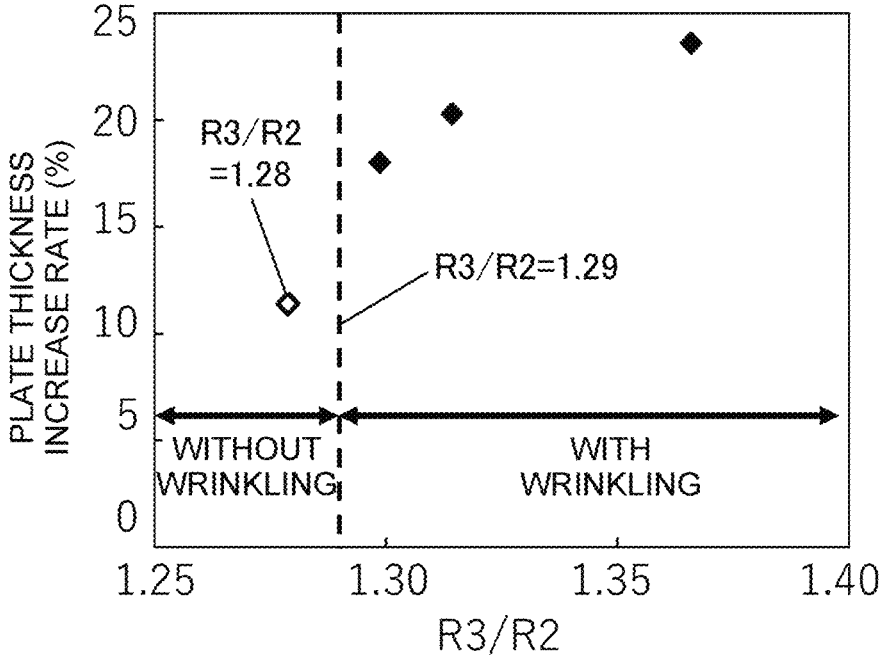
FIG. 28 is a chart illustrating a simulation result of analysis models different in L2/L3.

The simulation result is illustrated in FIG. 28. Also in this simulation, the presence or absence of occurrence of wrinkling at the flange base portion is inferred from a plate thickness increase rate with the plate thickness increase rate at the flange base portion an evaluation index. As illustrated in FIG. 28, when R3/R2 is equal to or less than 1.29, the plate thickness increase rate is 15% or less, the wrinkling at the flange base portion can be suppressed. Note that in any of the analysis models, the plate thickness decrease rate at the flange tip was less than the plate thickness decrease rate in Comparative Example 1 in the simulation (1). Therefore, by performing the press forming according to the present invention under the condition that R3/R2 is 1.29 or less, it is possible to suppress the tensile strain at the flange tip and suppress the wrinkling at the flange base portion. The effect is further increased by performing the press forming according to the present invention under that the condition that L1/L2 is 1.05 or less and R3/R2 is 1.29 or less.

<Simulation (4)>

Figure 29:
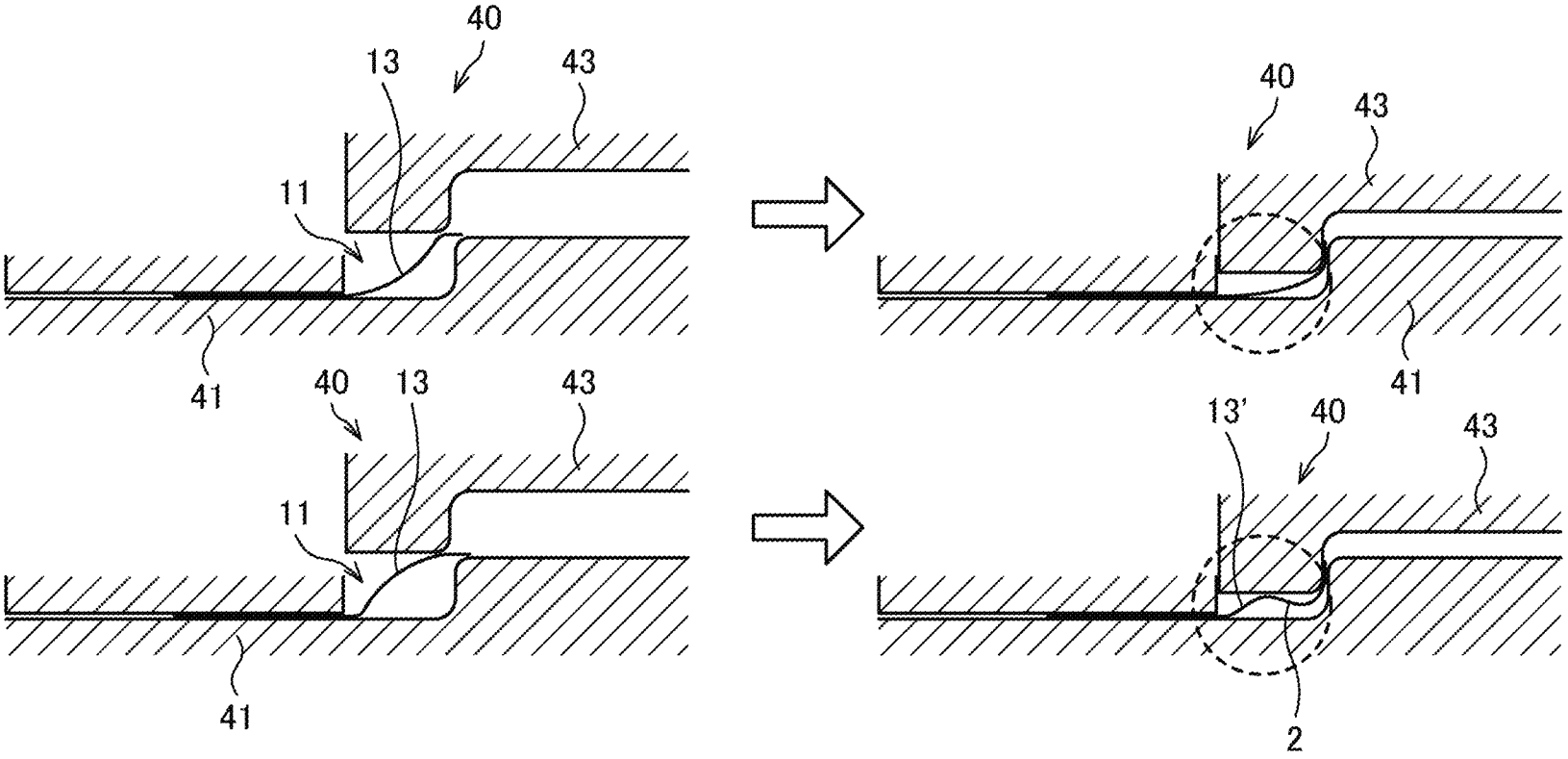
FIG. 29 is an explanatory view of an influence on the second face of the press formed product in the case where the raised face of the intermediate formed product was formed to be a curved face convex toward the press direction and in the case where the raised face of the intermediate formed product was formed to be a curved face convex toward a direction opposite to the press direction.

As illustrated in FIG. 29, a forming simulation was carried out for the influence, on the second face of the press formed product, in the case where the raised face 13 of the intermediate formed product 11 was formed to be a curved line convex toward the preforming punch 31 (convex downward) (FIG. 29 (*a*)) and in the case where the raised face 13 of the intermediate formed product 11 was formed to be a curved line convex toward the preforming die 33 (convex upward) (FIG. 29 (*a*)). In the case where the raised face 13 was formed to be a curved line convex toward the preforming punch 31 (convex downward) as illustrated in FIG. 29 (*a*), the raised face 13 was able to be press formed without causing wrinkling in the flange forming step. On the other hand, in the case where the raised face 13 was formed to be a curved line convex toward the preforming die 33 (convex upward) as illustrated in FIG. 29 (*b*), there was a possibility of causing wrinkling on the second face 2 in the flange forming step. The raised face 13 of the intermediate formed product 11 is desirably an almost linear shape or a curved face convex toward the press direction, between the first ridgeline 14 and the ridgeline-corresponding part 15.

INDUSTRIAL APPLICABILITY

The present invention is usable to manufacture a press formed product having a stretch flange part.

EXPLANATION OF CODES

1 press formed product having stretch flange part
2 face (second face)
3 flange
3*a* tip of flange
4 ridgeline (second ridgeline)
10 blank
10*a* cutout part
11 intermediate formed product
11*a* first intermediate formed product
11*b* second intermediate formed product
12 first face
13 raised face
13*a* tip of raised face
14 first ridgeline
15 ridgeline-corresponding part
20 press forming line
30 preforming apparatus
31 preforming punch
31*a* preforming punch bottom face part
31*b* preforming punch ceiling face part
31*c* preforming punch inclined face
31' preforming punch vertical wall part
31*d* concave ridgeline part
32 preforming pad
33 preforming die
33*a* preforming die ceiling part
33*b* preforming die inclined face
33*b*' preforming die vertical wall part
35 first face forming part
36 raised face forming part
36*a* tip of raised face forming part
36*b* position of ridgeline-corresponding part of intermediate formed product in raised face forming part
37 first ridgeline forming part
40 press forming apparatus
41 punch
41*a* punch bottom face part
41*b* punch ceiling face part
41*c* punch vertical wall face
41*c*' punch vertical wall part
41*d* punch concave ridgeline part
42 pad
42*a* pad vertical wall face
42*a*' pad vertical wall part
42*b* pad bottom face part
42*c* pad ridgeline part
43 die
43*a* die bottom face part
43*b* die ceiling face part
43*c* die vertical wall face
43*c*' die vertical wall part
45 second face forming part
46 flange forming part
46*a* tip of flange forming part
47 second ridgeline forming part
50 cutting machine
80 first component
81 second component
82 joint
82*a* first flange
82*b* second flange
82*c* third flange
H height of flange forming part
h height of raised face forming part
K difference between curvature radius of raised face tip and curvature radius of second ridgeline
R curvature radius of cutout part
R1 curvature radius of first ridgeline forming part
R2 curvature radius of second ridgeline forming part
R3 curvature radius at position of ridgeline-corresponding part of intermediate formed product in raised face forming part

What is claimed is:

1. A manufacturing method of a press forming product, the method comprising:

constraining a first face of an intermediate formed product, the intermediate formed product comprising the first face, a raised face, and a first ridgeline located between the first face and the raised face, and performing a flange forming step of press forming the raised face into a part of a second face, a part of a flange, and a part of a second ridgeline located between the second face and the flange, wherein:

the first ridgeline extends while being convexly curved in a direction from the raised face toward the first face, and the second ridgeline extends while being convexly curved in a direction from the flange toward the second face, viewed from a press direction of the press forming;

a convex direction of the first ridgeline in a cross section along the press direction intersecting with the first ridgeline and a convex direction of the second ridgeline in a cross section along the press direction intersecting with the second ridgeline are on the same side;

a curvature radius, on a straight line orthogonal to the second ridgeline, in an extending direction of the first ridgeline at an intersection with the straight line in the intermediate formed product is larger than a curvature radius in an extending direction of the second ridgeline on the straight line after the flange forming step; and a first angle θ1 is formed by the raised face and the first face which are adjacent to the first ridgeline in the intermediate formed product, a second angle θ2 is formed by the second face at a corresponding position to the first ridgeline in the press formed product, and the second angle θ2 is larger than the first angle θ1.

2. The manufacturing method of a press forming product according to claim 1, wherein a length from the first ridgeline to a tip of the raised face in the intermediate formed product is 1.00 to 1.05 times a length from the position corresponding to the first ridgeline to a tip of the flange after the flange forming step.

3. The manufacturing method of a press forming product according to claim 1, wherein a height of the raised face in the intermediate formed product is equal to or larger than a height of the flange after the flange forming step.

4. The manufacturing method of a press forming product according to claim 1, wherein a curvature radius in an extending direction of a ridgeline-corresponding part being a portion in the intermediate formed product which becomes the second ridgeline is 1.29 times or less the curvature radius in the extending direction of the second ridgeline after the flange forming step.

5. The manufacturing method of a press forming product according to claim 1, wherein the raised face of the intermediate formed product is formed to be a curved line convex toward the press direction in a cross section along the press direction intersecting with the first ridgeline.

6. The manufacturing method of a press forming product according to claim 1, further comprising a preforming step of forming the intermediate formed product.

7. The manufacturing method of a press forming product according to claim 6, further comprising a trim step after the preforming step, wherein in the trim step, a tip portion of the raised face is cut according to the height of the flange formed in the flange forming step.

8. A press forming apparatus, comprising a punch, a die, and a pad, wherein:

the punch comprises a punch vertical wall part, a punch bottom face part, and a concave ridgeline part located between the punch vertical wall part and the punch bottom face part;

the die comprises a die vertical wall part, a die bottom face part, and a die shoulder ridgeline part located between the die vertical wall part and the die bottom face part;

the pad comprises a pad vertical wall part, a pad bottom face part, and a pad ridgeline part located between the pad vertical wall part and the pad bottom face part;

the pad ridgeline part extends while being convexly curved in a direction from the die toward the pad in a state viewed in a press direction;

the die shoulder ridgeline part extends while being convexly curved in a direction from the punch vertical wall part toward the die vertical wall part in the state viewed in the press direction;

the pad vertical wall part is arranged adjacent to the die;

the punch vertical wall part and the die vertical wall part are oppositely adjacent to each other at a forming bottom dead center;

the punch bottom face part and the die bottom face part are oppositely adjacent to each other at the forming bottom dead center;

the pad bottom face part and the punch bottom face part are directly next to each other at the forming bottom dead center; and a curvature radius, on a straight line orthogonal to the die shoulder ridgeline part, in an extending direction of the pad ridgeline part at an intersection with the straight line is larger than a curvature radius in an extending direction of the die shoulder ridgeline part on the straight line.

9. A press forming line comprising the press forming apparatus according to claim 8 and a preforming apparatus, wherein:

the preforming apparatus comprises a preforming punch and a preforming die;

the preforming punch comprises a preforming punch vertical wall part, a preforming punch bottom face part, and a preforming punch concave ridgeline part located between the preforming punch vertical wall part and the preforming punch bottom face part;

the preforming die comprises a preforming die vertical wall part, a preforming die bottom face part, and a preforming die shoulder ridgeline part located between the preforming die vertical wall part and the preforming die bottom face part;

the preforming die shoulder ridgeline part extends while being convexly curved in a direction from the preforming punch vertical wall part toward the preforming die vertical wall part in a state viewed in a press direction;

the preforming punch vertical wall part and the preforming die vertical wall part are oppositely adjacent to each other at a forming bottom dead center;

the preforming punch bottom face part and the preforming die bottom face part are oppositely adjacent to each other at the forming bottom dead center;

a curvature radius in an extending direction of the preforming die shoulder ridgeline part at an intersection with a straight line orthogonal to the preforming die shoulder ridgeline part of the preforming apparatus and intersecting with the preforming die shoulder ridgeline part of the preforming apparatus is larger than a curvature radius in an extending direction of the die shoulder ridgeline part on the straight line; and an angle formed by the die bottom face part and the pad bottom face part which are adjacent to the pad ridgeline part is larger than an angle formed by the preforming die vertical wall part and the preforming die bottom face part which are adjacent to the preforming die shoulder ridgeline part in a cross section along the press direction intersecting with the preforming die shoulder ridgeline part of the preforming die of the preforming apparatus and the pad ridgeline part of the pad of the press forming apparatus.

* * * * *